US011692478B2

(12) United States Patent
Faller et al.

(10) Patent No.: US 11,692,478 B2
(45) Date of Patent: Jul. 4, 2023

(54) LINEAR COMBUSTION ENGINES WITH VALVE IN PISTON

(71) Applicant: Intelline Inc., Waterloo (CA)

(72) Inventors: Kyle Timothy Faller, Kitchener (CA); Jason Rwang Young, Cambridge (CA)

(73) Assignee: Intelline Inc., Waterloo (CA)

( * ) Notice: Subject to any disclaimer, the term of this patent is extended or adjusted under 35 U.S.C. 154(b) by 0 days.

(21) Appl. No.: 17/796,042

(22) PCT Filed: Jan. 29, 2021

(86) PCT No.: PCT/CA2021/050102
§ 371 (c)(1),
(2) Date: Jul. 28, 2022

(87) PCT Pub. No.: WO2021/151207
PCT Pub. Date: Aug. 5, 2021

(65) Prior Publication Data

US 2023/0058375 A1 Feb. 23, 2023

Related U.S. Application Data

(60) Provisional application No. 62/968,183, filed on Jan. 31, 2020.

(51) Int. Cl.
*F01L 11/02* (2006.01)
*F02B 75/28* (2006.01)
(Continued)

(52) U.S. Cl.
CPC ..... *F02B 75/28* (2013.01); *F01L 11/02* (2013.01); *F02B 71/04* (2013.01); *F02F 3/0076* (2013.01)

(58) Field of Classification Search
CPC ..... F01L 11/02; F01L 21/04
(Continued)

(56) References Cited

U.S. PATENT DOCUMENTS 4,530,317 A 7/1985 Schutten
6,651,599 B2 11/2003 Wechner
(Continued)

FOREIGN PATENT DOCUMENTS

EP 1999353 A2 12/2008
WO 2006060859 A1 6/2006

OTHER PUBLICATIONS

International Search Report and Written Opinion dated Apr. 6, 2021, in related International Application No. PCT/CA2021/050102.

*Primary Examiner* — Long T Tran
*Assistant Examiner* — James J Kim
(74) *Attorney, Agent, or Firm* — Bereskin & Parr LLP/S.E.N.C.R.L., s.r.l.

(57) ABSTRACT

Linear generators with a piston having a valve are described herein. The linear generator includes a combustion module and at least one linear motor. The linear motor includes at least one piston having: a piston head with an opening therein; a piston skirt opposed to the piston head; a piston side wall extending between the piston head and the piston skirt, the piston side wall having at least one port therein. The piston also includes a valve mechanism movable relative to each of the piston head, the piston seat and the piston side wall. The valve mechanism includes a valve stem extending through the piston skirt and the interior piston volume into a mover shaft of the motor, and a valve head coupled to the valve stem and configured to cover the opening of the piston head.

20 Claims, 27 Drawing Sheets

(51) Int. Cl.
*F02F 3/00* (2006.01)
*F02B 71/04* (2006.01)

(58) Field of Classification Search
USPC ..... 123/47 R
See application file for complete search history.

(56) References Cited

U.S. PATENT DOCUMENTS

| | | | | |
|---|---|---|---|---|
| 8,640,659 | B2 | 2/2014 | Daouk | |
| 9,091,204 | B2 | 7/2015 | McAlister | |
| 10,550,737 | B2 * | 2/2020 | Harmon, Sr. ..... | F01L 23/00 |
| 2021/0047982 | A1 * | 2/2021 | Engelmann ..... | F02F 3/042 |

* cited by examiner

LINEAR COMBUSTION ENGINES WITH VALVE IN PISTON

CROSS-REFERENCE

The application is a 35 USC § 371 national stage entry of International Application No. PCT/CA2021/050102, filed Jan. 29, 2021, entitled "LINEAR COMBUSTION ENGINES WITH VALVE IN PISTON", which claims priority to U.S. Provisional Patent Application No. 62/968,183 dated Jan. 31, 2020, the entire contents of each of which are incorporated herein by reference for all purposes.

TECHNICAL FIELD

This application relates to a system for converting combustion energy into useful work. More particularly, this application relates to combustion chamber geometry and valve mechanisms for linear internal combustion engines.

BACKGROUND

Internal combustion engines convert combustion of air and fuel into linear motion of a piston, and commonly use a crankshaft to convert linear motion to rotating motion. Linear engines also have a combustion chamber and piston, but do not have a crankshaft. The linear piston motion is converted into electricity by means of a linear electric generator. Linear engines can achieve high efficiency, as they eliminate the need to convert energy into rotary motion before use. A linear engine with a shared combustion chamber, or in other words contains two opposed pistons in a shared cylinder, can achieve high thermal efficiencies and is also very well balanced due to the mirrored piston motion. Opposed piston linear engines have traditionally been implemented as two-stroke engines. Implementation of a variable displacement or 4-stroke opposed piston linear engine has traditionally not been practical. A cylinder head cannot be implemented with an opposed piston layout. Embedding of valves in the cylinder walls would contribute to significant losses, as clearance volumes required to accommodate reasonable valve timing would result in unwanted extra volume in the combustion chamber, making it difficult to achieve good combustion efficiency, airflow, and compression ratios.

SUMMARY OF THE INVENTION

It is an object of the present application to provide a combustion chamber and valve mechanism for systems for converting combustion energy into useful work, which obviates or mitigates at least one disadvantage of the prior art.

According to a first aspect, there is provided a 4-stroke combustion chamber with valvetrain components in a piston.

According to another aspect, a piston such as but not limited to being for a linear generator, is provided. The piston includes a piston head having an opening therein; a piston skirt opposed to the piston head; a piston shaft extending from the piston skirt; a piston side wall extending between the piston head and the piston skirt, the piston head, the piston seat and the piston side wall co-operating to define an interior piston volume, the piston side wall having at least one port therein to provide a pathway between the interior piston volume and an exterior piston volume; and a valve mechanism movable relative to each of the piston head, the piston seat and the piston side wall, the valve mechanism including: a valve stem extending through the piston skirt and the interior piston volume; and a valve head coupled to the valve stem and configured to cover the opening of the piston head; wherein the valve mechanism is movable between a first position where the valve head is covering the opening of the piston head and a second position where the valve head extends outwardly from the piston head into a combustion chamber of a motor to expose the opening and provide a pathway between the interior piston volume and the combustion chamber.

In at least one embodiment, the piston shaft defines a valve guide hole configured to carry the valve stem.

In at least one embodiment, the valve guide hole includes a gas bearing, a ball bearing, a frictional bearing material or lubrication to provide for smooth motion of the valve mechanism.

In at least one embodiment, the valve guide hole is concentric with the valve head.

In at least one embodiment, the piston also includes a biasing mechanism positioned between the piston shaft and a valve spring retainer, the valve spring retainer engaging the valve stem to bias the valve head against the piston head.

In at least one embodiment, the biasing mechanism is a spring.

In at least one embodiment, the valve guide hole extends into a mover shaft of the motor, the mover shaft being joined to the piston shaft.

In at least one embodiment, the valve stem extends through the valve guide hole into a valve cylinder of the mover shaft.

In at least one embodiment, the port of the piston side wall is transverse to the opening in the piston head.

In at least one embodiment, the piston side wall includes more than one port.

In at least one embodiment, each port of the piston side wall is transverse to the opening in the piston head.

In at least one embodiment, the piston side wall has a smaller radius than the piston head and the piston skirt.

In at least one embodiment, the valve head and the opening of the piston head are concentric circles.

In at least one embodiment, the piston further comprises a second valve mechanism movable relative to each of the piston head, the piston seat and the piston side wall, the second valve mechanism including: a second valve stem extending through the piston skirt and the interior piston volume; and a second valve head coupled to the valve stem and configured to cover a second opening of the piston head; wherein the second valve mechanism is movable between a first position where the second valve head is covering the second opening of the piston head and a second position where the second valve head extends outwardly from the piston head into a combustion chamber of a motor to expose the opening and provide a pathway between the interior piston volume and the combustion chamber.

In at least one embodiment, the interior piston volume includes a first interior piston volume and a second interior piston volume, the first interior piston volume being fluidly coupled to the combustion chamber by the first opening and the second interior combustion volume being fluidly coupled to the combustion chamber by the second opening.

According to another aspect, a linear generator is provided. The linear generator includes a combustion module and at least one linear motor. Each linear motor has at least one piston. The piston includes: a piston head having an opening therein; a piston skirt opposed to the piston head; a piston side wall extending between the piston head and the piston skirt, the piston head, the piston seat and the piston side wall co-operating to define a interior piston volume, the piston side wall having at least one port therein to provide a pathway between the interior piston volume and an exterior piston volume; and a valve mechanism movable relative to each of the piston head, the piston seat and the piston side wall, the valve mechanism including: a valve stem extending through the piston skirt and the interior piston volume into a mover shaft of the motor; and a valve head coupled to the valve stem and configured to cover the opening of the piston head. The valve mechanism is movable between a first position where the valve head is covering the opening of the piston head and a second position where the valve head extends outwardly from the piston head into a combustion chamber of the combustion module to expose the opening and provide a pathway between the interior piston volume and the combustion chamber.

In at least one embodiment, the linear generator includes two linear motors, the linear motors being positioned on opposed sides of the combustion chamber.

In at least one embodiment, the combustion chamber is defined by a cylinder wall, the valve head of the piston of each linear motor and the piston head of the piston of each linear motor.

In at least one embodiment, the combustion chamber is a sealed space.

In at least one embodiment, when the piston of each linear motor is in the second position, combustion gases in the combustion chamber may pass into the interior volume of each of the pistons.

These and other features and advantages of the present application will become apparent from the following detailed description taken together with the accompanying drawings. It should be understood, however, that the detailed description and the specific examples, while indicating preferred embodiments of the application, are given by way of illustration only, since various changes and modifications within the spirit and scope of the application will become apparent to those skilled in the art from this detailed description.

BRIEF DESCRIPTION OF THE DRAWINGS

For a better understanding of the various embodiments described herein, and to show more clearly how these various embodiments may be carried into effect, reference will be made, by way of example, to the accompanying drawings which show at least one example embodiment, and which are now described. The drawings are not intended to limit the scope of the teachings described herein.

Figure 1:
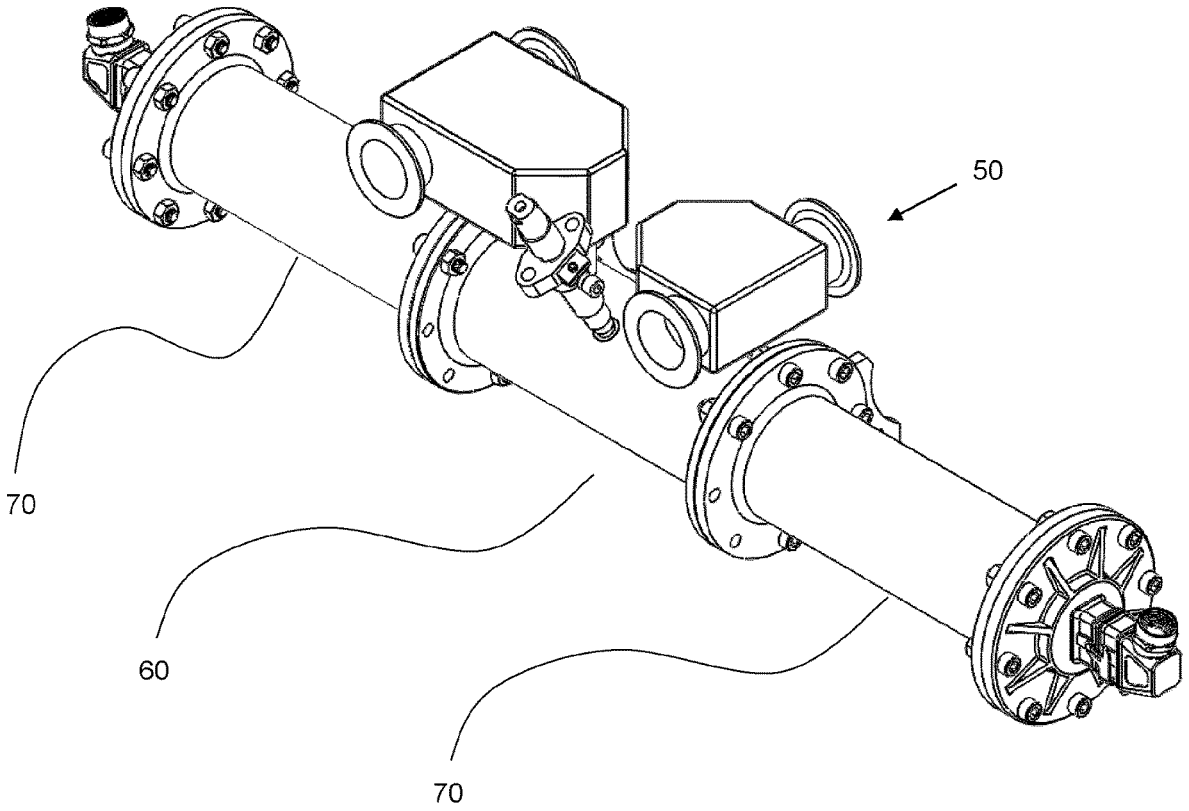
FIG. 1 shows an isometric view of a linear generator.

Further aspects and features of the example embodiments described herein will appear from the following description taken together with the accompanying drawings.

DETAILED DESCRIPTION OF EXAMPLE EMBODIMENTS

Various apparatuses, methods and compositions are described below to provide an example of at least one embodiment of the claimed subject matter. No embodiment described below limits any claimed subject matter and any claimed subject matter may cover apparatuses and methods that differ from those described below. The claimed subject matter are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed subject matter. Any subject matter that is disclosed in an apparatus, method or composition described herein that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

It should be noted that terms of degree such as "substantially", "about" and "approximately" as used herein mean a reasonable amount of deviation of the modified term such that the end result is not significantly changed. These terms of degree should be construed as including a deviation of the modified term, such as 1%, 2%, 5%, or 10%, for example, if this deviation does not negate the meaning of the term it modifies.

Furthermore, the recitation of any numerical ranges by endpoints herein includes all numbers and fractions subsumed within that range (e.g. 1 to 5 includes 1, 1.5, 2, 2.75, 3, 3.90, 4, and 5). It is also to be understood that all numbers and fractions thereof are presumed to be modified by the term "about" which means a variation up to a certain amount of the number to which reference is being made, such as 1%, 2%, 5%, or 10%, for example, if the end result is not significantly changed.

It should also be noted that, as used herein, the wording "and/or" is intended to represent an inclusive-or. That is, "X and/or Y" is intended to mean X, Y or X and Y, for example. As a further example, "X, Y, and/or Z" is intended to mean X or Y or Z or any combination thereof. Also, the expression of A, B and C means various combinations including A; B; C; A and B; A and C; B and C; or A, B and C.

The following description is not intended to limit or define any claimed or as yet unclaimed subject matter. Subject matter that may be claimed may reside in any combination or sub-combination of the elements or process steps disclosed in any part of this document including its claims and figures. Accordingly, it will be appreciated by a person skilled in the art that an apparatus, system or method disclosed in accordance with the teachings herein may embody any one or more of the features contained herein and that the features may be used in any particular combination or sub-combination that is physically feasible and realizable for its intended purpose.

A linear generator is indicated generally at 50 in FIG. 1. A linear generator 50 includes a combustion module indicated generally at 60, and at least one linear electric motor indicated generally at 70. The embodiment of linear generator 50 shown in FIG. 1 includes two linear electric motors 70 mounted to the combustion module 60. Specifically, the two linear electric motors 70 of the linear generator 50 shown in FIG. 1 are mounted to opposed ends of the combustion module 60.

Figure 2:
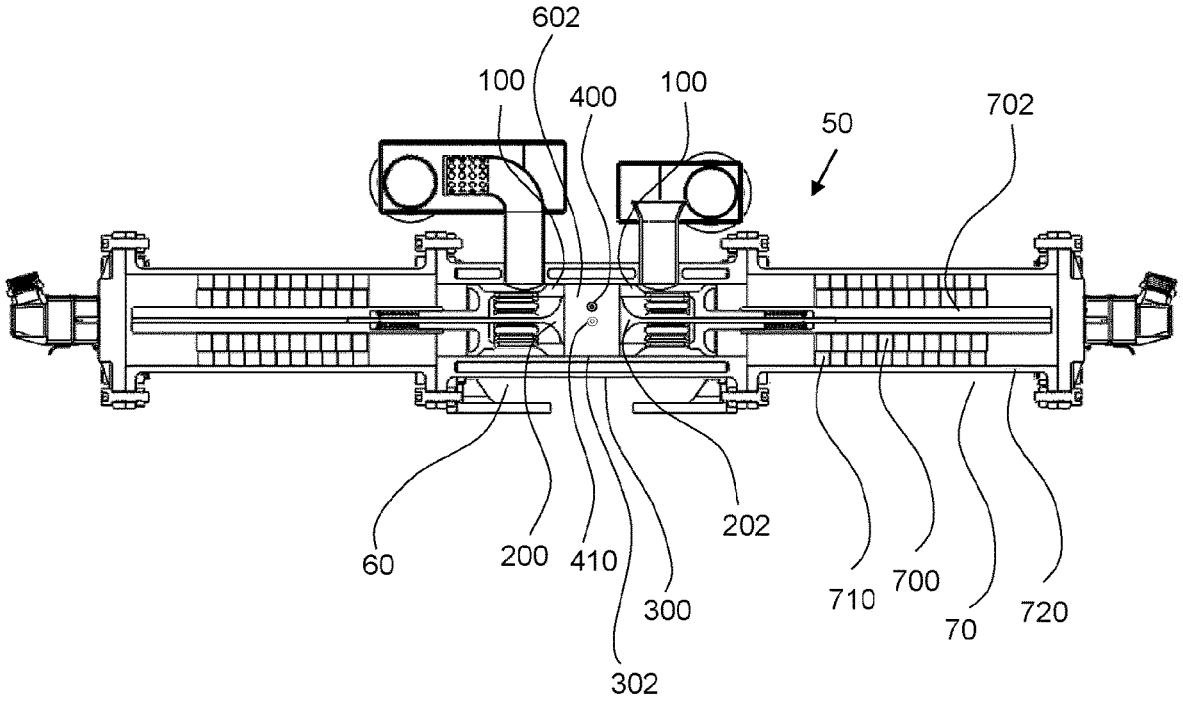
FIG. 2 shows a cross-section view of a linear generator.

FIG. 2 shows a cross-section view of a linear generator 50. Combustion module 60 includes at least one piston 100, at least one intake valve 200, at least one exhaust valve 202, a cylinder 300, at least one fuel injector 400, and, depending on the type of fuel used, may include one or multiple spark plugs 410, or one or multiple glow plugs 420. In at least one embodiment, each piston 100 includes one valve 200. In at least one embodiment, each piston include more than one valve 200, such as but not limited to two valves 200, or three valves 200, or four valves 200, or more than four valves 200.

A linear electric motor 70 includes a mover 700, a stator 710, and a casing 720. A linear electric motor may convert linear motion of the mover to electric power. For example, during the power stroke of the 4-stroke combustion cycle, pressure from combustion is converted to linear motion of the piston 100, which may be coupled to the mover shaft 702 of a linear electric motor 70, such that relative motion of the magnetic fields within the linear electric motor 70 produce a current in the windings, thereby completing the system function of converting chemical energy from combustible fuel into electricity. A linear electric motor 70 may also convert electric power to thrust force. For example, when starting the linear generator 50, the linear electric motors 70 may use input current to create a thrust force in the mover shaft 702, which may be coupled to a piston 100, such that initial compression of an air/fuel mixture can be achieved and allow combustion to take place. Another example in which the linear electric motor 70 may be used to produce thrust force from an input current would be during non-power strokes: intake stroke, compression stroke, exhaust stroke. It may be desirable to add linear electric motor 70 thrust power during one or multiple of these strokes to maintain consistent or desired stroke length and velocity properties.

Figure 3A:
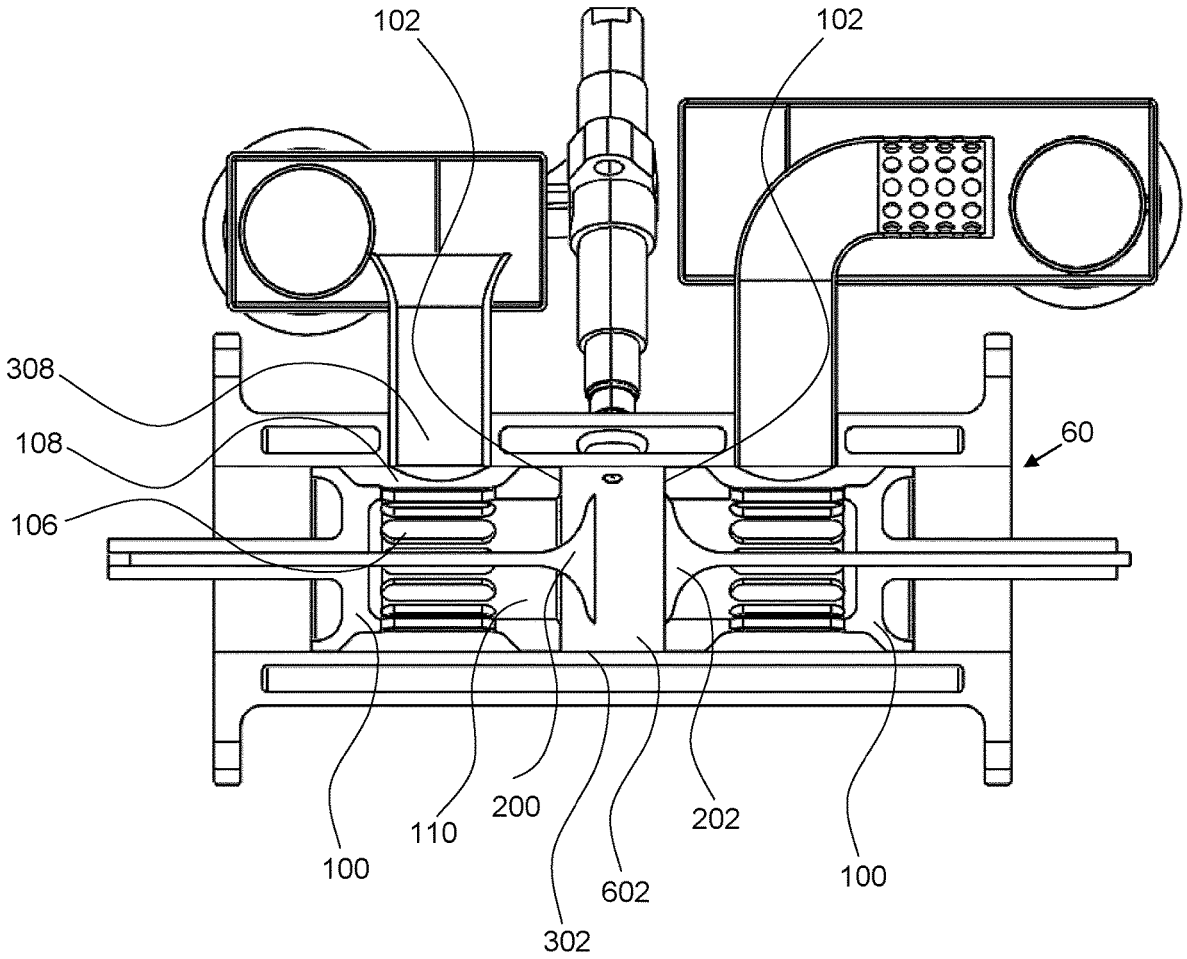
FIG. 3A shows a cross-section view of a combustion module 60, with piston and valve positions corresponding to an intake stroke.

FIG. 3A shows a cross-section view of a combustion module 60, with piston 100 and valve positions corresponding to an intake stroke. This embodiment of a combustion module 60 shows a dual-opposed piston configuration, in which there are two pistons 100, mirror images of each other, in a shared combustion chamber 602. The piston heads 102 and cylinder wall 302 enclose a cylindrical volume that is the combustion chamber 602. Unlike a common automobile internal combustion engine, there is no cylinder head. The combustion chamber 602 is a sealed space, which may be achieved via piston rings, a clearance seal, or any other means of sealing the gap between moving piston 100 and cylinder wall 302. The combustion chamber 602 may be pressurized, such as during a compression stroke or combustion. Matter may only enter or leave the combustion chamber via the intake valve 200 or exhaust valve 202, each located in a piston 100. During the intake stroke, the two pistons 100 move away from each-other, thus increasing the volume of the combustion chamber 602. Air may flow in through the intake port 308, then into the exterior piston intake volume 108, through the piston intake port 106, into the interior piston intake volume 110, and when the intake valve 200 is open, air flows into the combustion chamber 602.

Figure 3B:
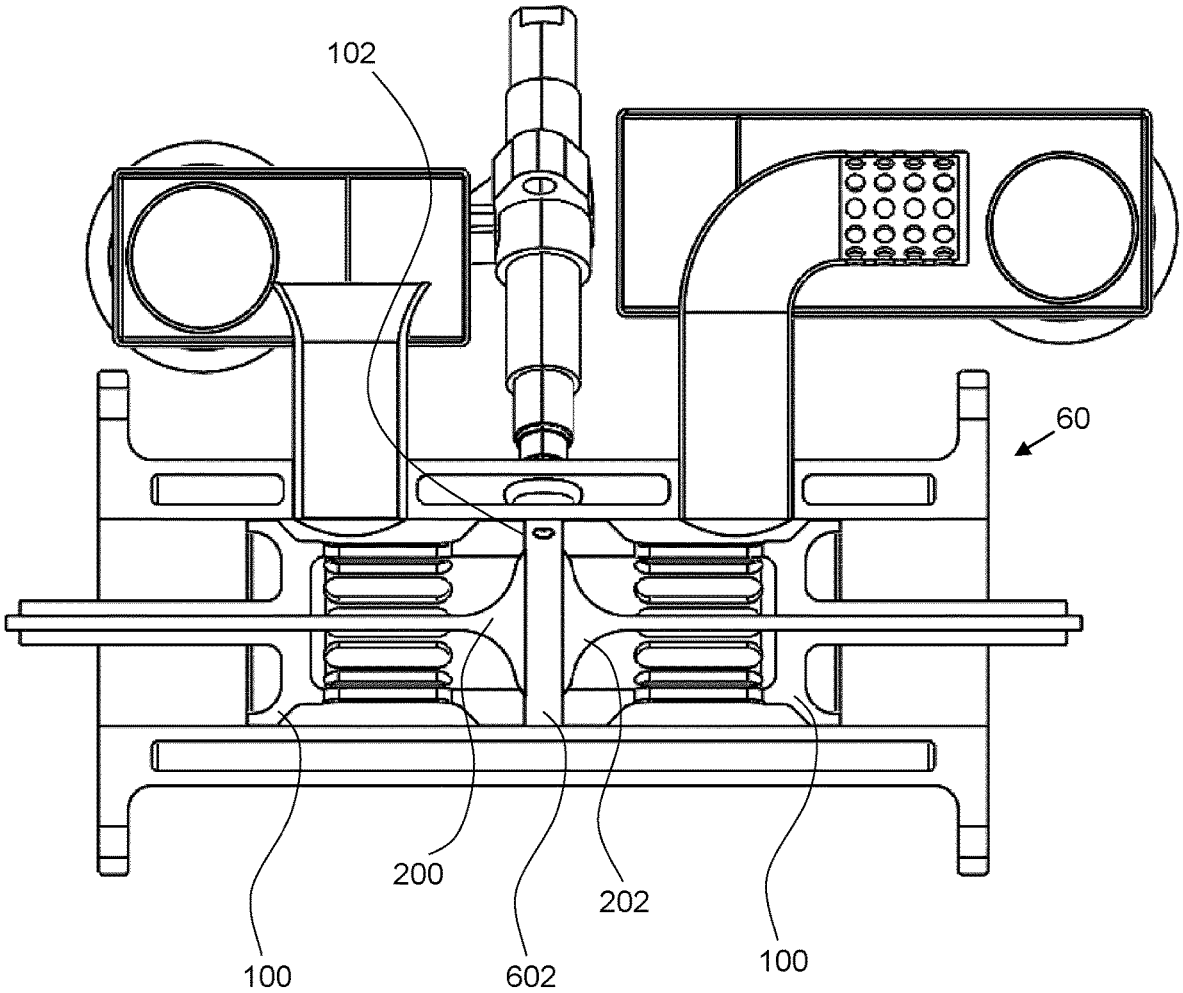
FIG. 3B shows a cross-section view of a combustion module 60, with piston and valve positions corresponding to a compression stroke.

FIG. 3B shows a cross-section view of a combustion module 60, with piston and valve positions corresponding to a compression stroke. When the intake valve 200 and exhaust valve 202 are seated against the piston head 102, which may also be described as closed, and the two pistons are moving towards each other, compression is achieved in the combustion chamber 602. Piston 100 motion may be a result of residual motion from a power stroke in the previous cycle, input thrust force from the linear electric motors 70, or a combination of both.

Figure 3C:
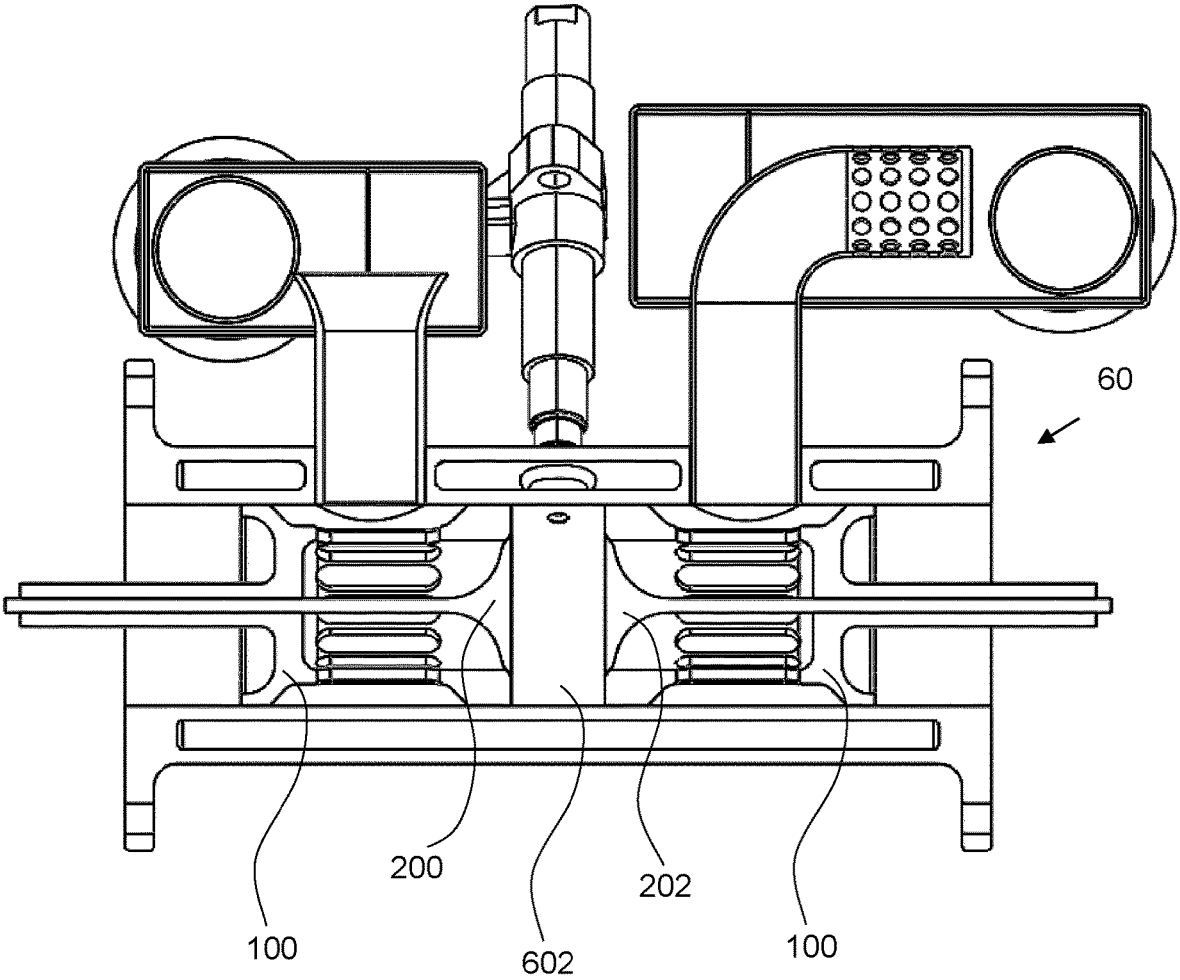
FIG. 3C shows a cross-section view of a combustion module 60, with piston and valve positions corresponding to a combustion stroke.

FIG. 3C shows a cross-section view of a combustion module 60, with piston and valve positions corresponding to a combustion stroke. When the intake valve 200 and exhaust valve 202 are closed, and sufficient compression for a given fuel type is achieved in the combustion chamber 602, combustion of fuel in the enclosed combustion chamber creates a significant pressure increase. The pistons 100 are movable boundaries of the combustion chamber 602, and will move away from each other as a result of the pressure in the combustion chamber 602. This stroke is the power stroke, in which combustion energy drives piston motion, in turn driving the mover shaft 702 and mover 700 of the linear electric motor 70, creating electricity.

Figure 3D:
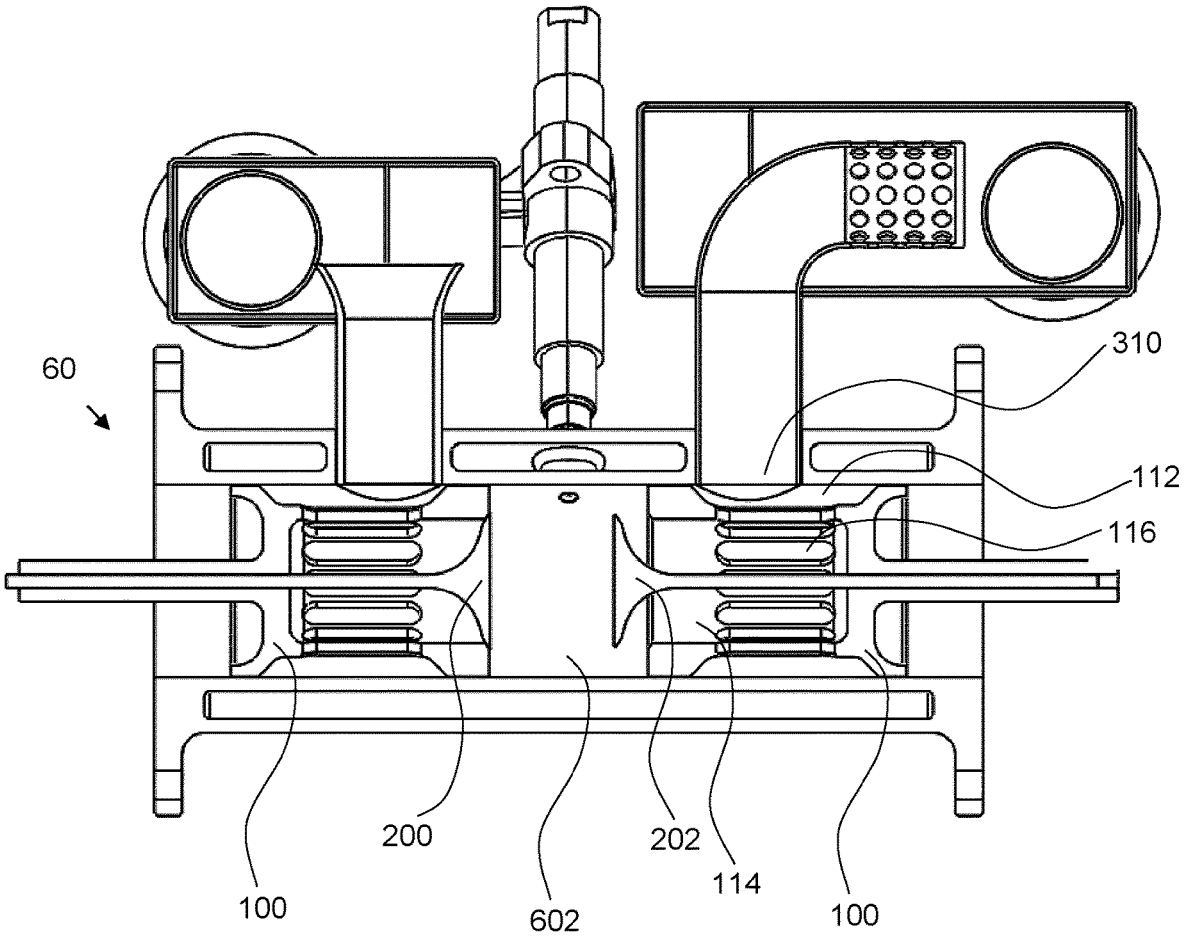
FIG. 3D shows a cross-section view of a combustion module 60, with piston and valve positions corresponding to an exhaust stroke.

FIG. 3D shows a cross-section view of a combustion module 60, with piston and valve positions corresponding to an exhaust stroke. After a combustion stroke, exhaust gas remains in the combustion chamber 602. With the exhaust valve 202 open, and pistons 100 moving towards each other, Combustion chamber 602 volume is decreased, thus forcing the exhaust gases out of the combustion chamber 602, into the interior piston exhaust volume 114, through the piston exhaust ports 116, into the exterior piston exhaust volume 112 and out the exhaust port 310.

Figure 4A:
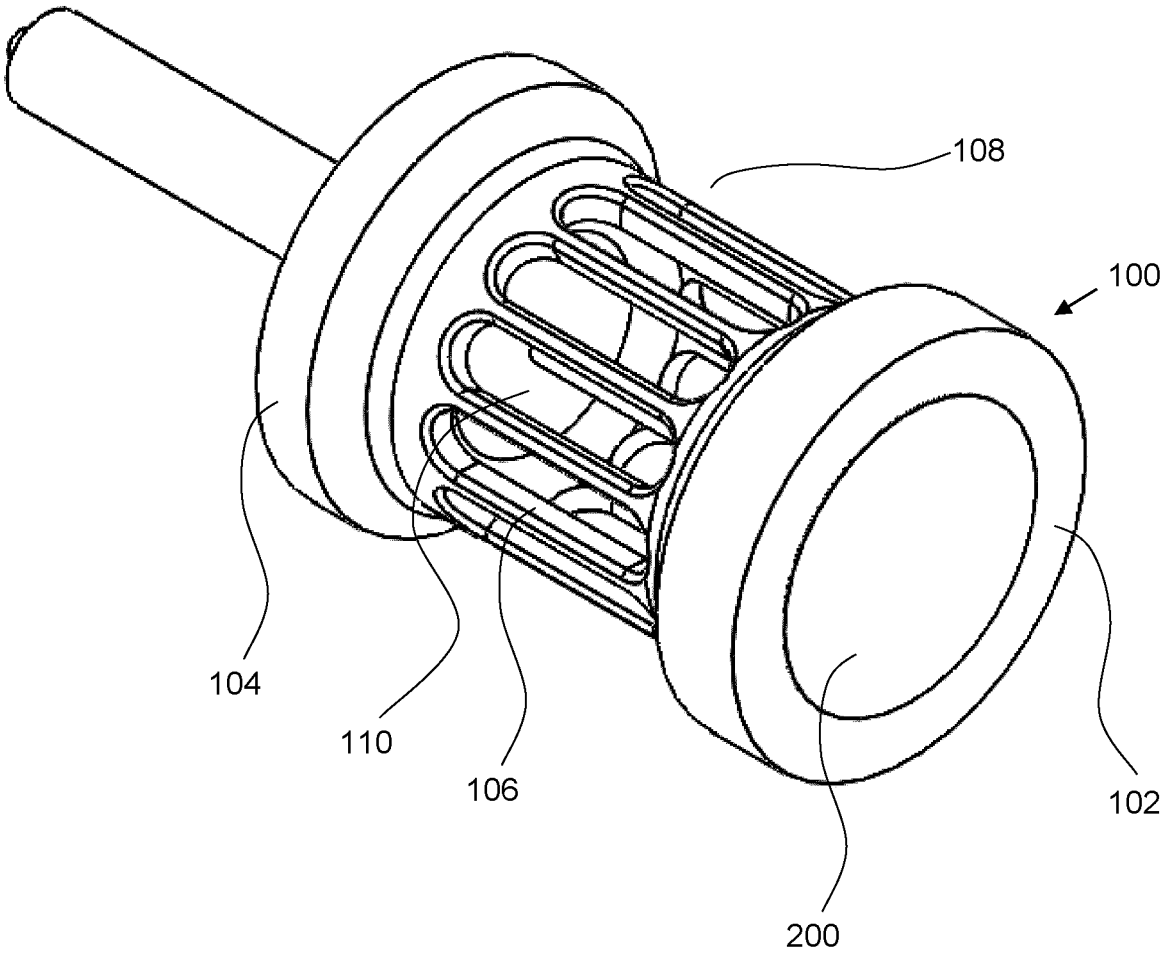
FIG. 4A shows an isometric view of a piston 100 and intake valve 200 or exhaust valve 202, with the valve closed.

FIG. 4A shows an isometric view of a piston 100 and intake valve 200 or exhaust valve 202, with the valve closed. Both intake and exhaust valve and piston fundamental design is the same, but may be sized differently to achieve the most favourable gas flow characteristics. The embodiment shown in FIG. 4A will be identified at the intake piston 100. The piston 100 includes features that enable gas flow through the piston 100, and an intake valve mechanism to block or allow gas flow through the piston head 102 when desired. A section of the piston 100, with a smaller radius than the rest of the piston 100 and length greater than the intake port 308 length, is identified as the exterior piston intake volume 108. The smaller radius of the piston 100, cylinder wall 302, piston head 102 and piston skirt 104 form a complete enclosed space that is the exterior piston intake volume 108. This volume may be of uniform cross section radially around the piston 100, or one or multiple sections of removed material from the piston 100 forming an enclosed volume adjacent to the intake port 308. There may be one or multiple intake ports, positioned radially around the cylinder 300, which allow gas flow into the exterior piston intake volume 108. There may be one or multiple piston intake ports 106 that allow gas flow out of the exterior piston intake volume and into the interior piston intake volume 110. The interior piston intake volume 110 is a volume inside the piston enclosed by the intake valve 200. When the intake valve 200 is closed, gas cannot flow from the interior piston intake volume 110 into the combustion chamber 602. Similarly, gases in the combustion chamber 602 cannot flow into the interior piston intake volume 110 when the intake valve 200 is closed. The intake valve 200, closed against the piston head 102 forms a complete boundary such that pressure created in combustion can be converted into linear motion of the piston 100.

Figure 4B:
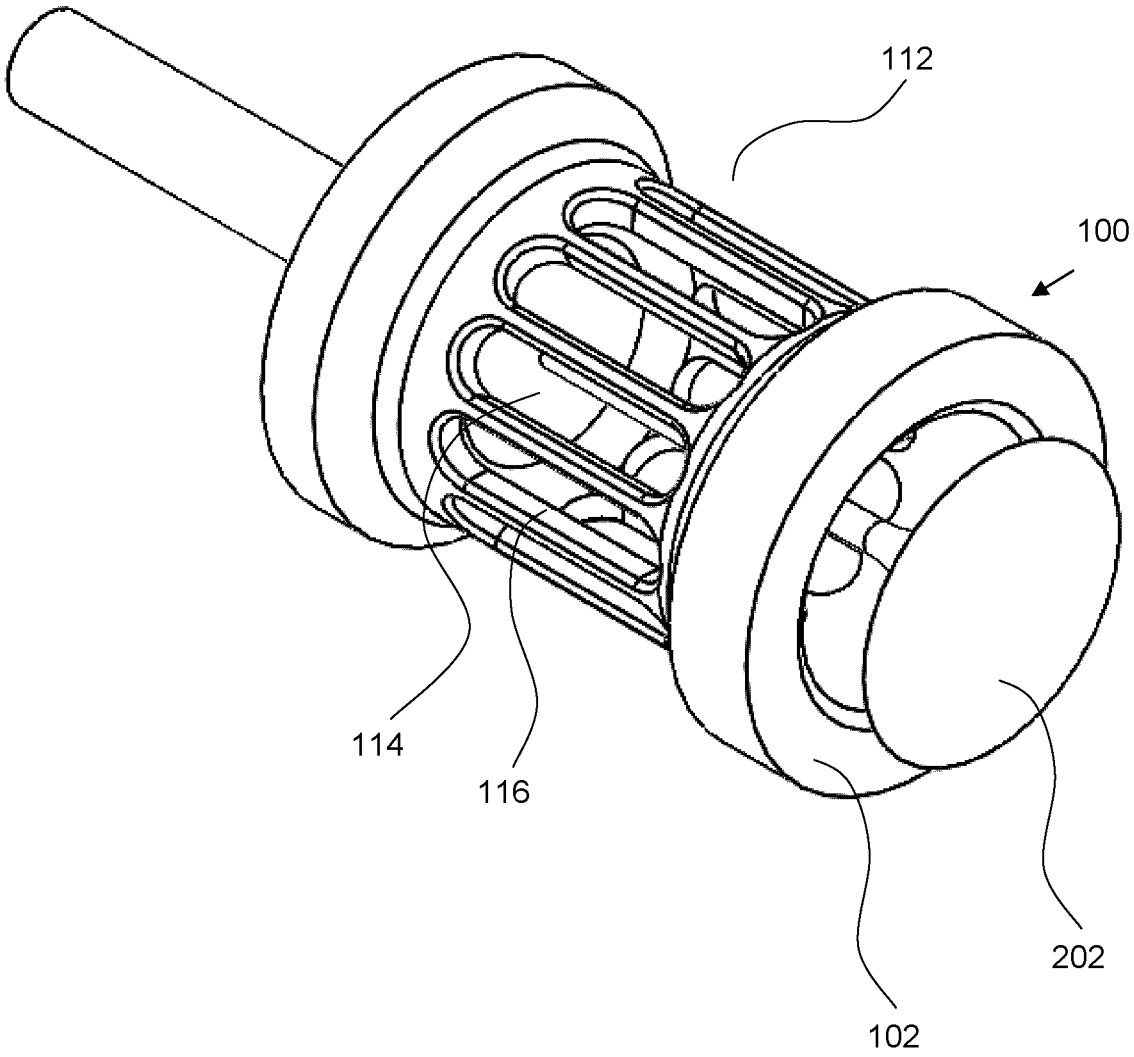
FIG. 4B shows an isometric view of a piston 100 and intake valve 200 or exhaust valve 202, with the valve open.

FIG. 4B shows an isometric view of a piston 100 and intake valve 200 or exhaust valve 202, with the valve open. The embodiment shown in FIG. 4B will be identified as the exhaust piston 100. The exhaust side piston 100 includes similar features to the intake side piston 100, with the exception that combustion gases flow in the reverse order. Specifically, when the exhaust valve 202 is open, combustion gases can flow from the combustion chamber 602, into the interior piston exhaust volume 114, out the piston exhaust port 116 (of which there may be one or multiple), into the exterior piston exhaust volume 112, and out the exhaust port 310 (of which there may be one or multiple).

Figure 4C:
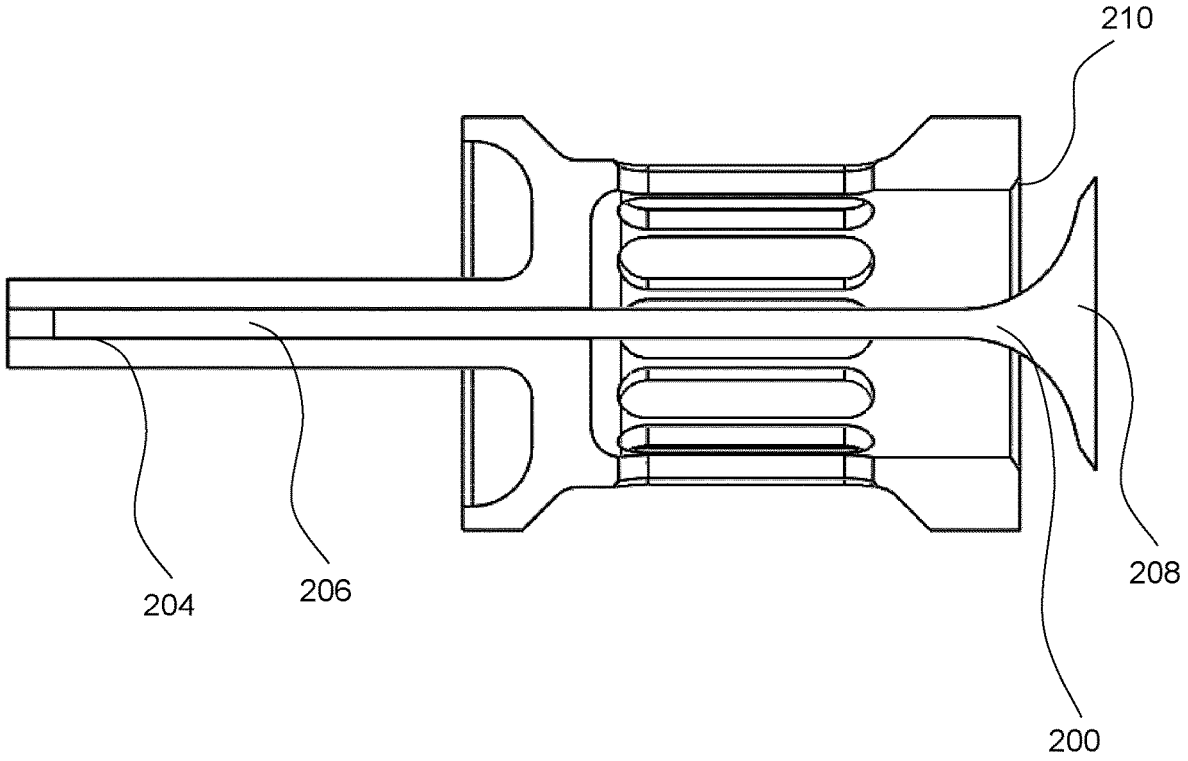
FIG. 4C shows a cross section view of a piston 100 and intake valve 200 or exhaust valve 202, with the valve open.

FIG. 4C shows a cross section view of a piston 100 and intake valve 200 or exhaust valve 202, with the valve open. A valve guide hole 204 is a through hole concentric with the piston that carries the valve stem 206. The valve guide hole 204 may include a gas bearing, ball bearing, frictional bearing material, and/or lubrication to allow smooth motion of the valve 200 relative to the piston 100 without seizing. The valve guide hole 204 also has the function of aligning the valve head 208 to the valve seat 210, and maintaining linear motion of the valve 200.

Figure 5:
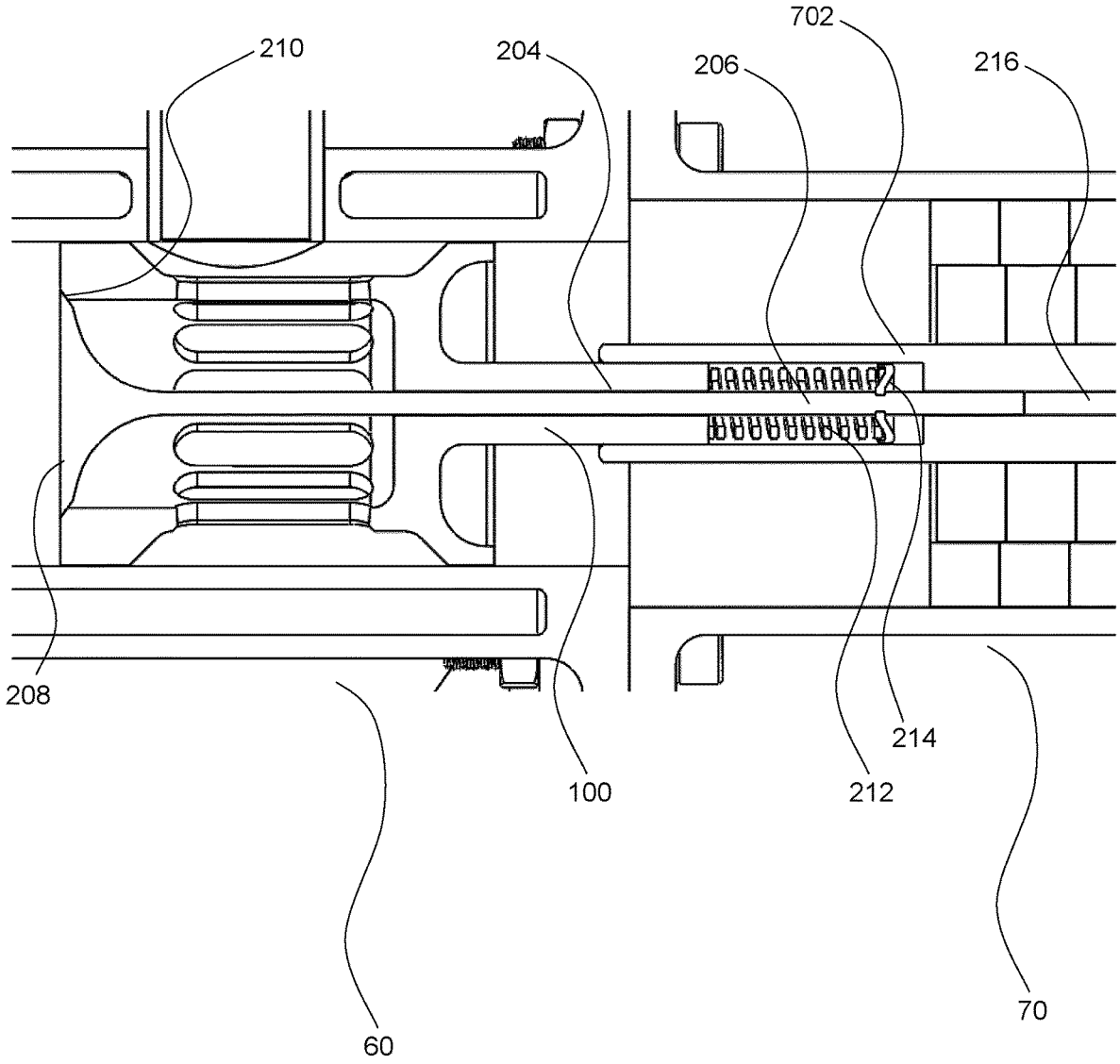
FIG. 5 shows a cross sectional view of an embodiment of the valve actuator mechanism.

FIG. 5 shows a cross sectional view of an embodiment of the valve actuator mechanism. The embodiment shown uses pneumatic or hydraulic pressure to actuate the valve when desired, and a valve spring 212 to keep the valve closed against the valve seat 210 while not actuated. The valve spring 212 is preloaded, with one face of the valve spring 212 seated against the piston shaft 118, and the opposing face of the valve spring 212 seated against the valve spring retainer 214. The preloaded valve spring 212 applies force to the valve spring retainer 214, which in turn applies force to the valve stem 206 to keep the valve head 208 closed against the valve seat 210. The mover shaft 702 has a pocket with a diameter large enough to accommodate the valve spring 212. The mover shaft 702 is joined to the piston shaft 118 by an interference fit, adhesive, threaded features, or other mechanical fastening methods. The valve stem 206 extends into the valve pneumatic/hydraulic cylinder 216 contained in the mover shaft 702. A flexible transfer line may connect the valve pneumatic/hydraulic cylinder 216 to a pressure source and control system to supply pressure when desired. When pressure is supplied to the valve pneumatic/hydraulic cylinder 216, force is applied to the back of the valve stem 206. When the applied force of pneumatic or hydraulic pressure exceeds that of the spring preload force, the valve is actuated, or opened. A balance of applied pressure, valve spring 212 stiffness, and inertia of the moving system determines the valve lift, or distance between the valve head 208 and piston head 102. Alternatively, a limiting feature may be included that stops the valve at a specified maximum lift position. Additional supplied pressure to the valve pneumatic/hydraulic cylinder 216 would not lift the valve any further, as the valve positon would be stopped at the limiting feature. Valve actuation may be achieved by other means, such as an additional linear motor to actuate the valve stem 206, or a shaft-mounted rotary electric motor to drive a cam system, in which a cam actuates the valve. Further, it should be noted that any of the methods of actuation of the valve described herein may be used of actuate the valve in both of its directions to its open or closed positions. For example, hydraulic pressure may push the valve open and also pull the valve shut. The component carrying out such a function in hydraulics or pneumatics would be a double-acting cylinder. Further, it should also be noted that any combination of actuation strategies may also be employed (e.g. hydraulic, pneumatics, and/or electrical parts working together to achieve opening and closing of the valve in a controlled manner). Further still, other alternatives are a linear electric motor actuating the valve in both directions, or a rotating electric motor with a cam and groove or other 'desmodromic' type cam system.

Figure 6:
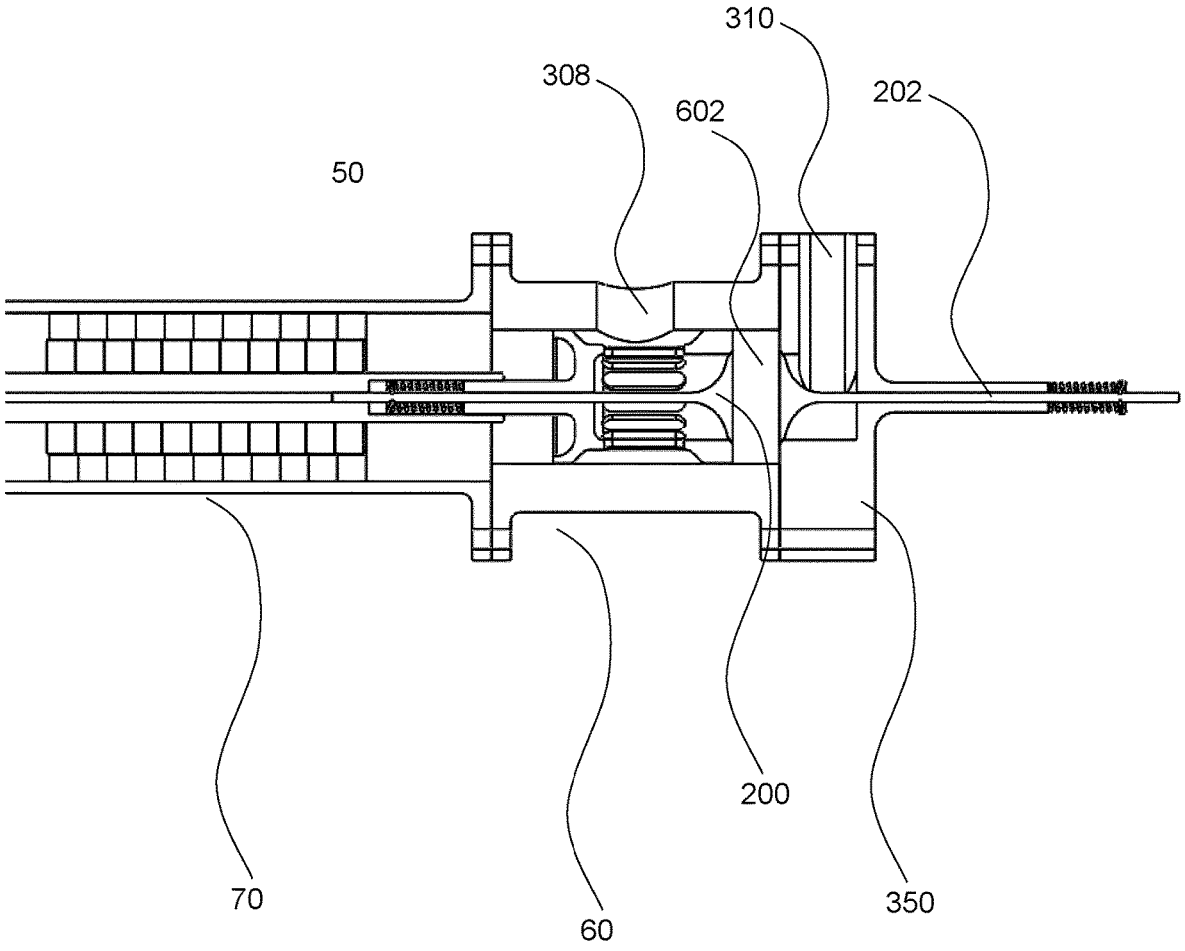
FIG. 6 shows a cross sectional view of a single piston embodiment of a linear generator 50.

FIG. 6 shows a cross sectional view of a single piston embodiment of a linear generator 50. In this embodiment, a cylinder head 350 containing the opposing valve is mounted to the combustion module 60 instead of a second linear electric motor 70. The piston 100 may contain the intake or exhaust components, and the cylinder head 350 contains the opposing set of components.

Figure 7:
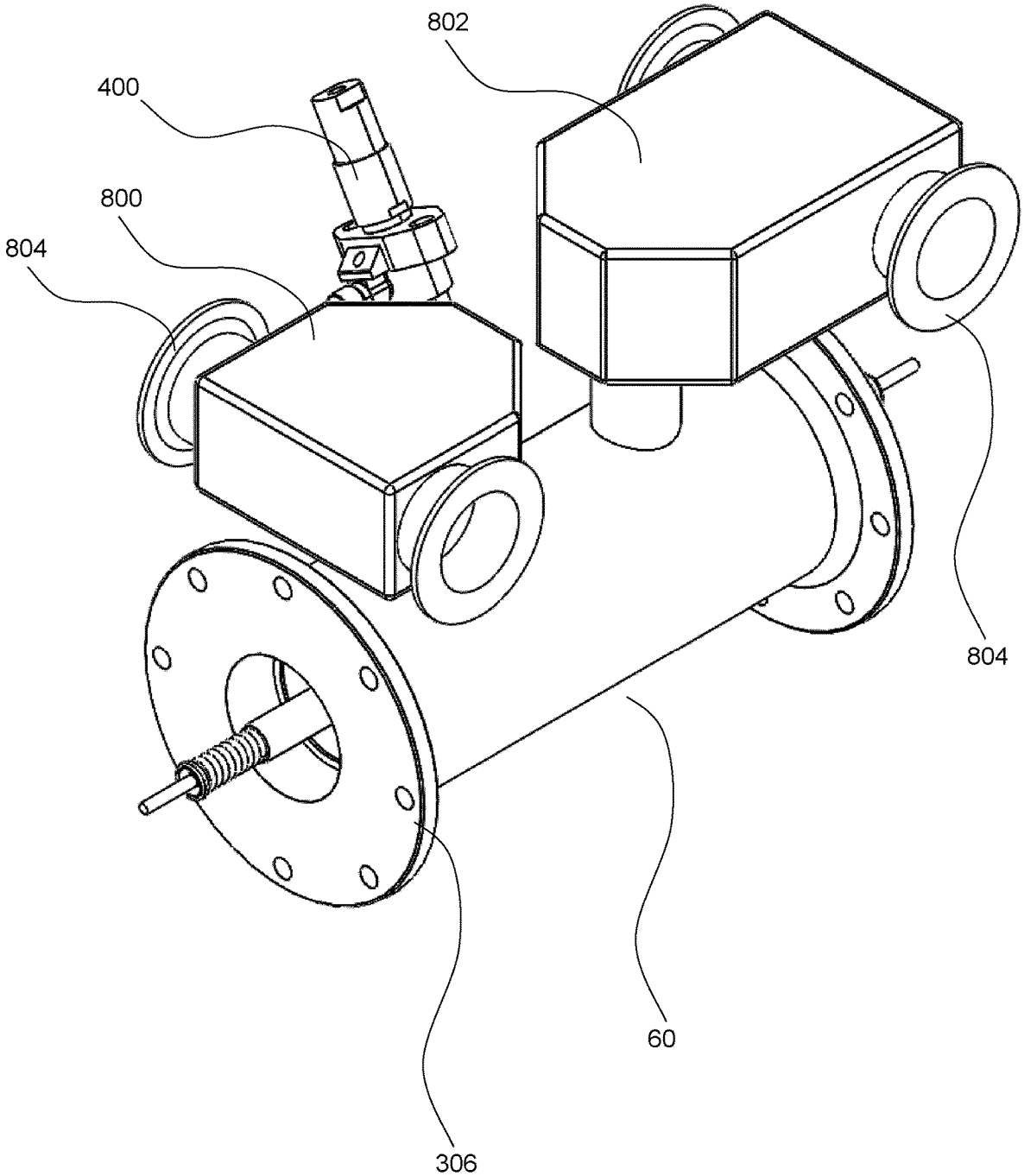
FIG. 7 shows an isometric view of a combustion module 60.

FIG. 7 shows an isometric view of a combustion module 60. The embodiment shown includes cylinder flanges 306 such that linear electric motors 70 or cylinder heads 350 may be mounted to the combustion module 60. The embodiment shown includes an intake manifold 800 and exhaust manifold 802. Both manifolds include manifold connections 804, such that combustion modules 60 can be joined together with common intake and exhaust manifolds. This is important for multi-module systems, as diesel exhaust treatment components need only be applied to the output of the manifold, and forced induction components such as a turbocharger need only be applied to the input of the intake manifold. Furthermore, the manifold style shown in this embodiment allows a single manifold design to be used for multiple combustion module 60 assemblies, thereby reducing manufacturing cost. Alternatively, custom intake and exhaust manifolds may be fabricated for each combustion module 60 assembly (i.e. a single module, or any multitude of modules). It should be noted that a separate manifold can be designed and common to multiple modules, rather than manifolds also being modular with each engine module.

Figure 8:
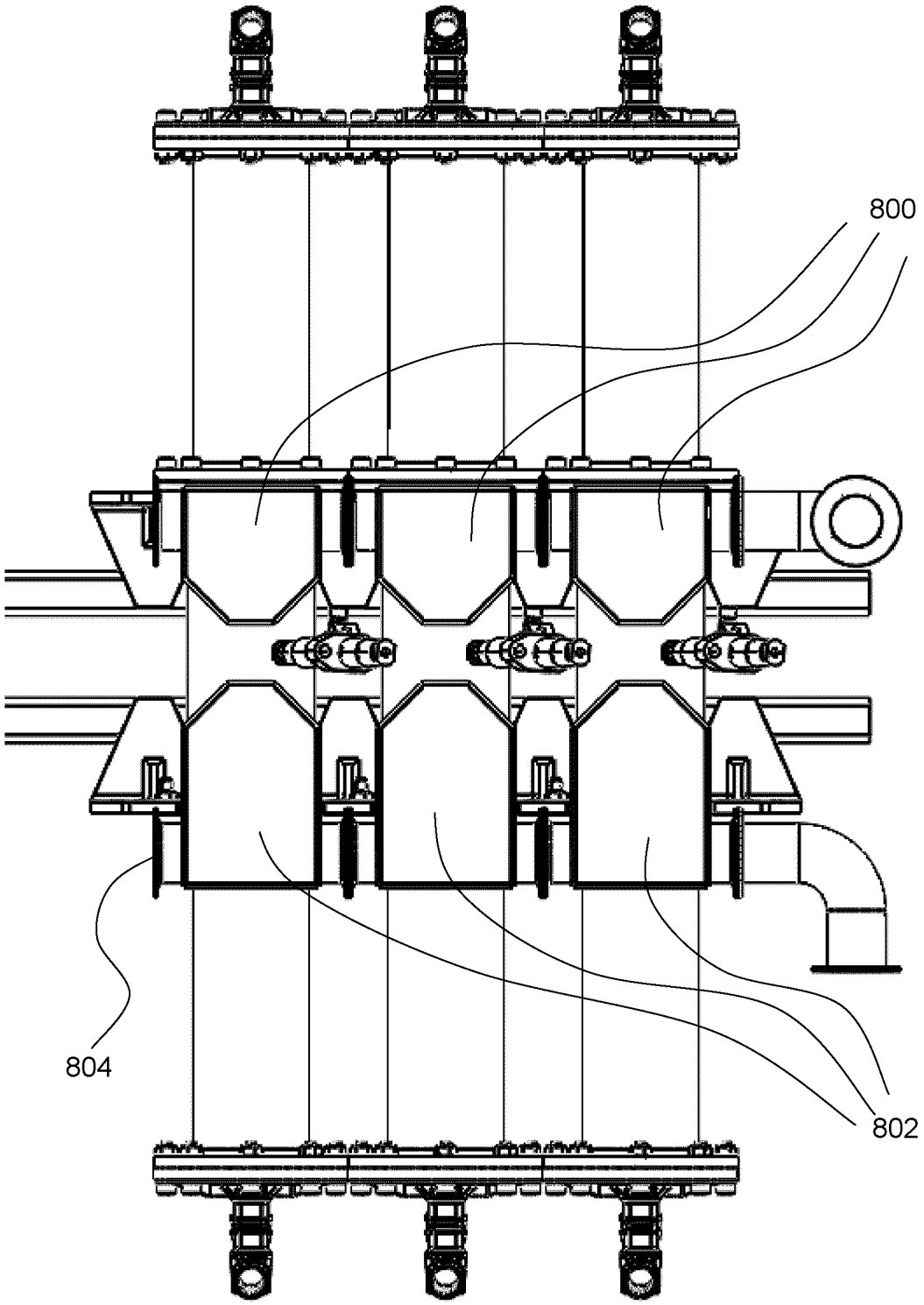
FIG. 8 shows a top view of a three combustion module 60 assembly.

FIG. 8 shows a top view of a three combustion module 60 assembly. This embodiment shows how the intake manifolds 800 and exhaust manifolds 802 can be linked at the manifold connections 804. The connections may be achieved via a bolted flange, clamp, or other means of mechanical fastening. This embodiment shows that the 4-stroke opposed piston engine can be combined in modules to form a generator with higher power output.

Figure 9A:
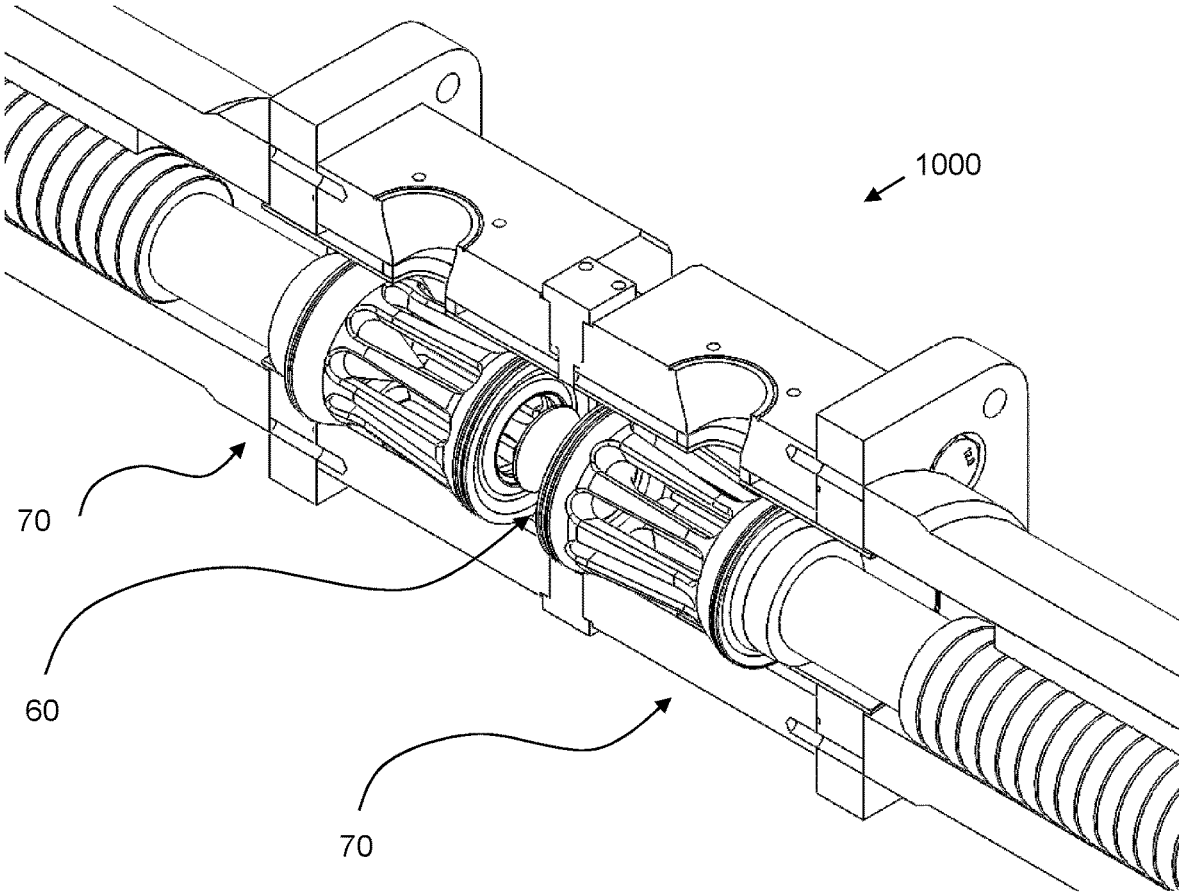
FIG. 9A shows an isometric view of a section of a linear generator according to another embodiment described herein.
Figure 9B:
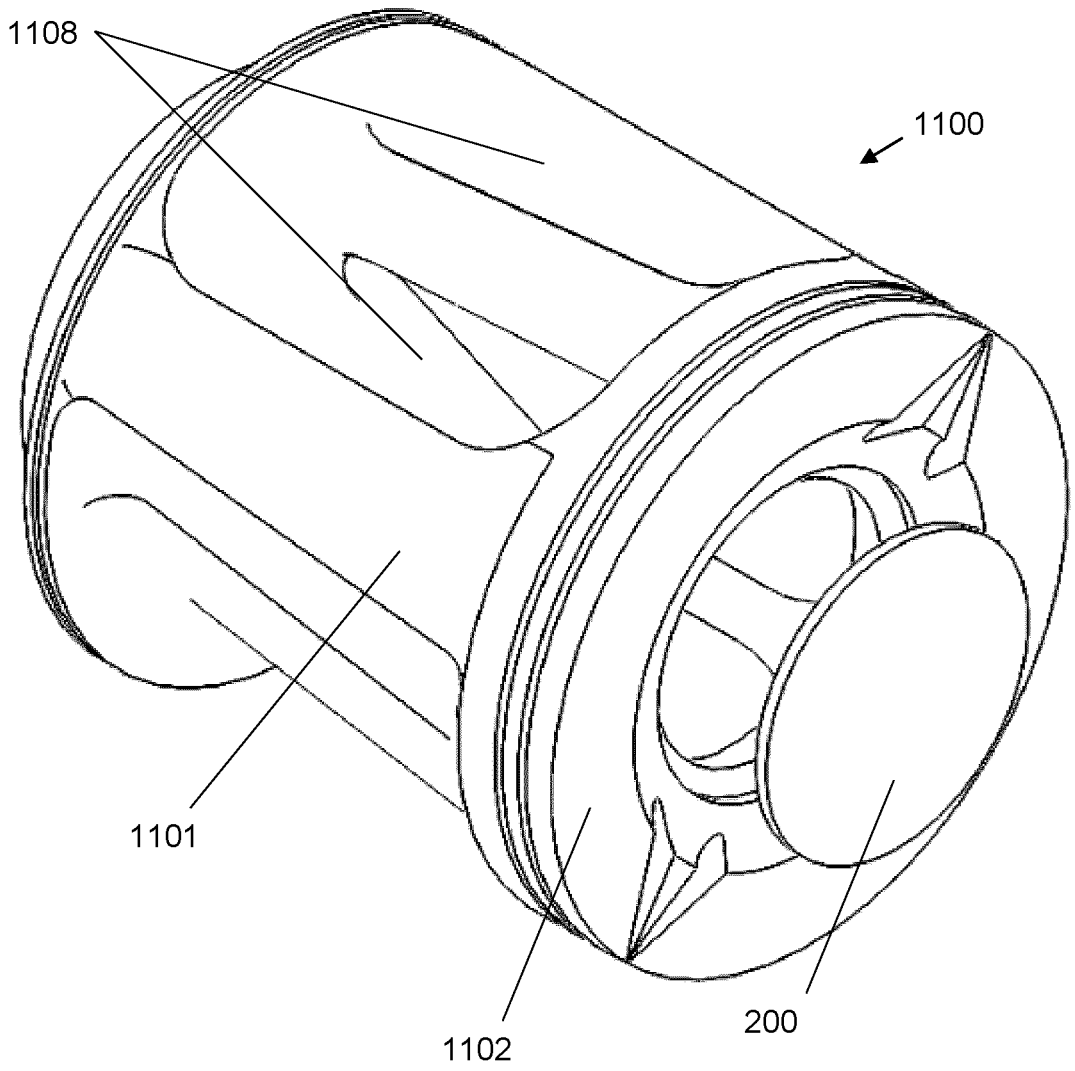
FIG. 9B shows an isometric view of a piston of the linear generator of FIG. 9A with a valve open from a first side, according to another embodiment described herein.
Figure 9C:
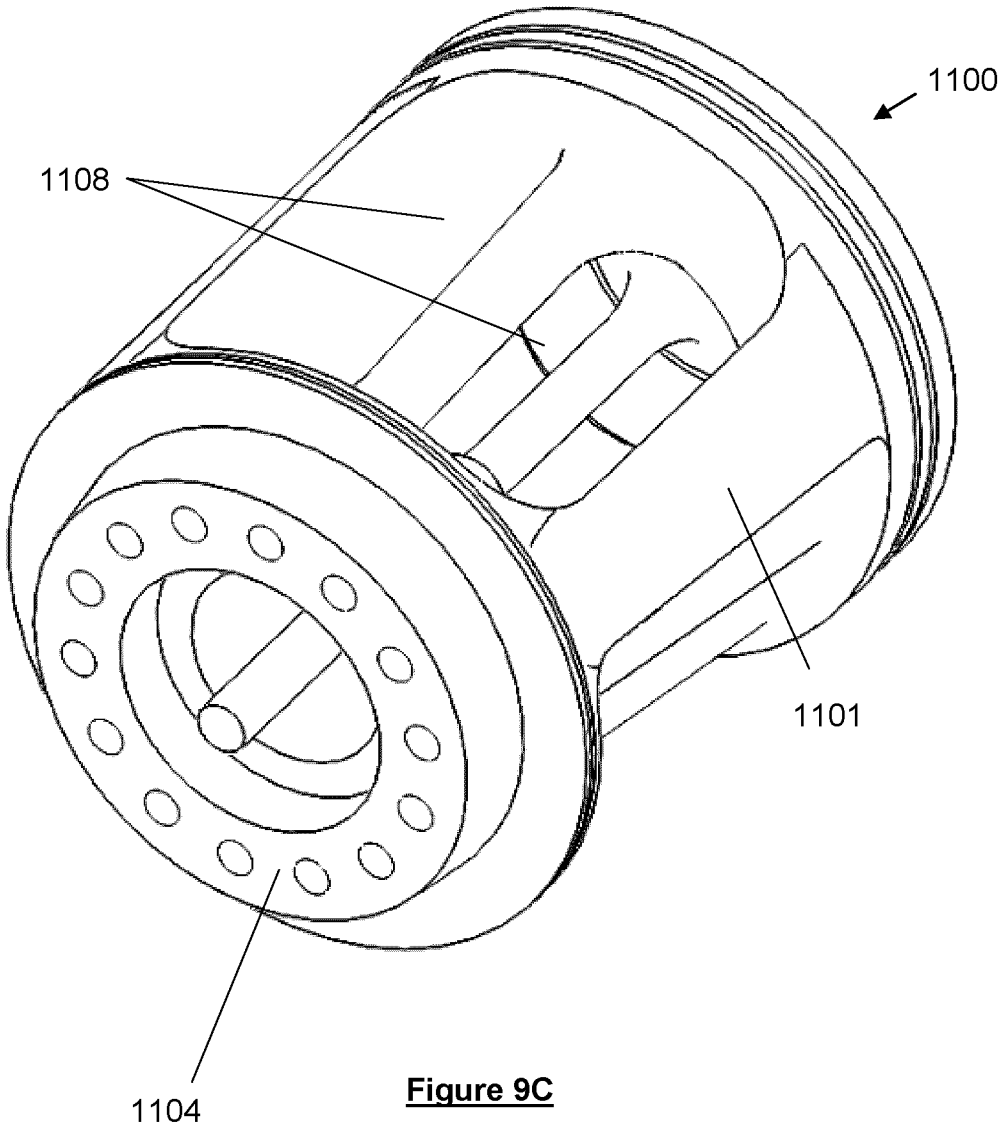
FIG. 9C shows an isometric view of the piston of FIG. 9B with a valve open from a second side.

FIG. 9A shows a linear generator 1000 according to another embodiment. Linear generator 1000 includes a combustion module indicated generally at 60, and at least one linear electric motor indicated generally at 70. The embodiment of linear generator 1000 shown in FIG. 9A also includes two linear electric motors 70 mounted to the combustion module 60. Again, as was shown in the embodiment shown in FIG. 1, the two linear electric motors 70 of the linear generator 1000 shown in FIG. 9A are mounted to opposed ends of the combustion module 60.

FIGS. 9B-9E show isometric views of a piston 1100 according to another embodiment. FIG. 9F show a cross sectional view of piston 1100. Piston 1100 is includes a valve mechanism to block or allow gas flow through the piston head 1102, when desired.

Piston 1100 also includes a side wall 1101 having a smaller radius than the rest of the piston 1100 and length greater than a length of the one or more intake ports 1108 defined by the side wall 1101. As in the embodiment of FIG. 5, the side wall 1101, a cylinder wall, the piston head 1102 and piston skirt 1104 form a complete enclosed space that is the exterior piston intake volume 1108. In this embodiment, the side wall 1101 tapers from the piston head 1102 to the piston skirt 1104 such that the radius of the side wall 1101 at the piston skirt 1104 is less than the radius of the side wall 1101 at the piston head 1102 (see FIG. 9F).

The one or more intake ports 1108 of side wall 1101 provide for gas to flow into and out of interior volume 1110 of piston 1100 (see FIG. 9F). The interior piston intake volume 1110 is a volume inside the piston. When the intake valve 200 is closed, gas cannot flow from the interior piston intake volume 110 into the combustion chamber 602. Similarly, gases in the combustion chamber 602 cannot flow into the interior piston intake volume 110 when the intake valve 200 is closed. The intake valve 200, closed against the piston head 102 forms a complete boundary such that pressure created in combustion can be converted into linear motion of the piston 100.

Figure 9D:
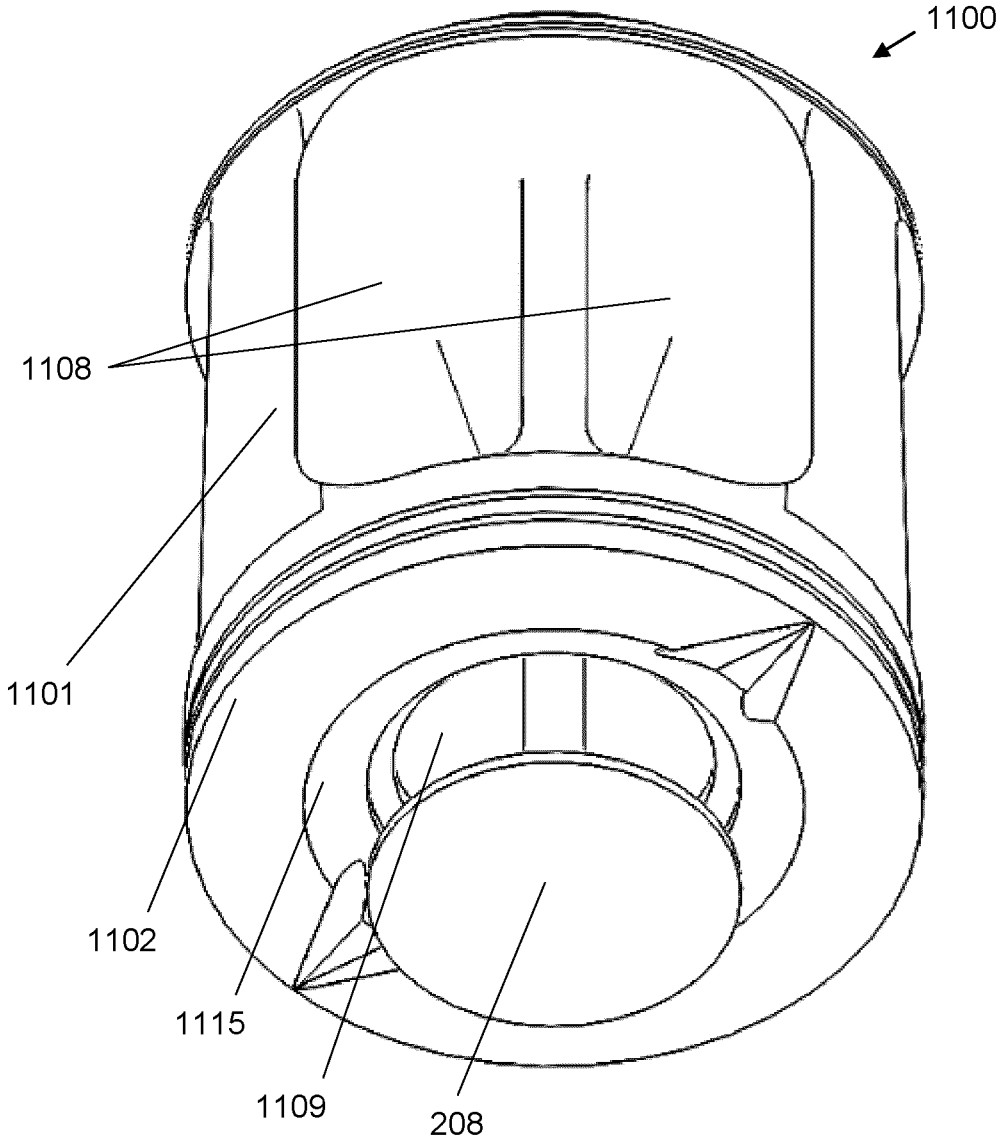
FIG. 9D shows another isometric view of the piston of FIG. 9B with a valve open from the first side.
Figure 9E:
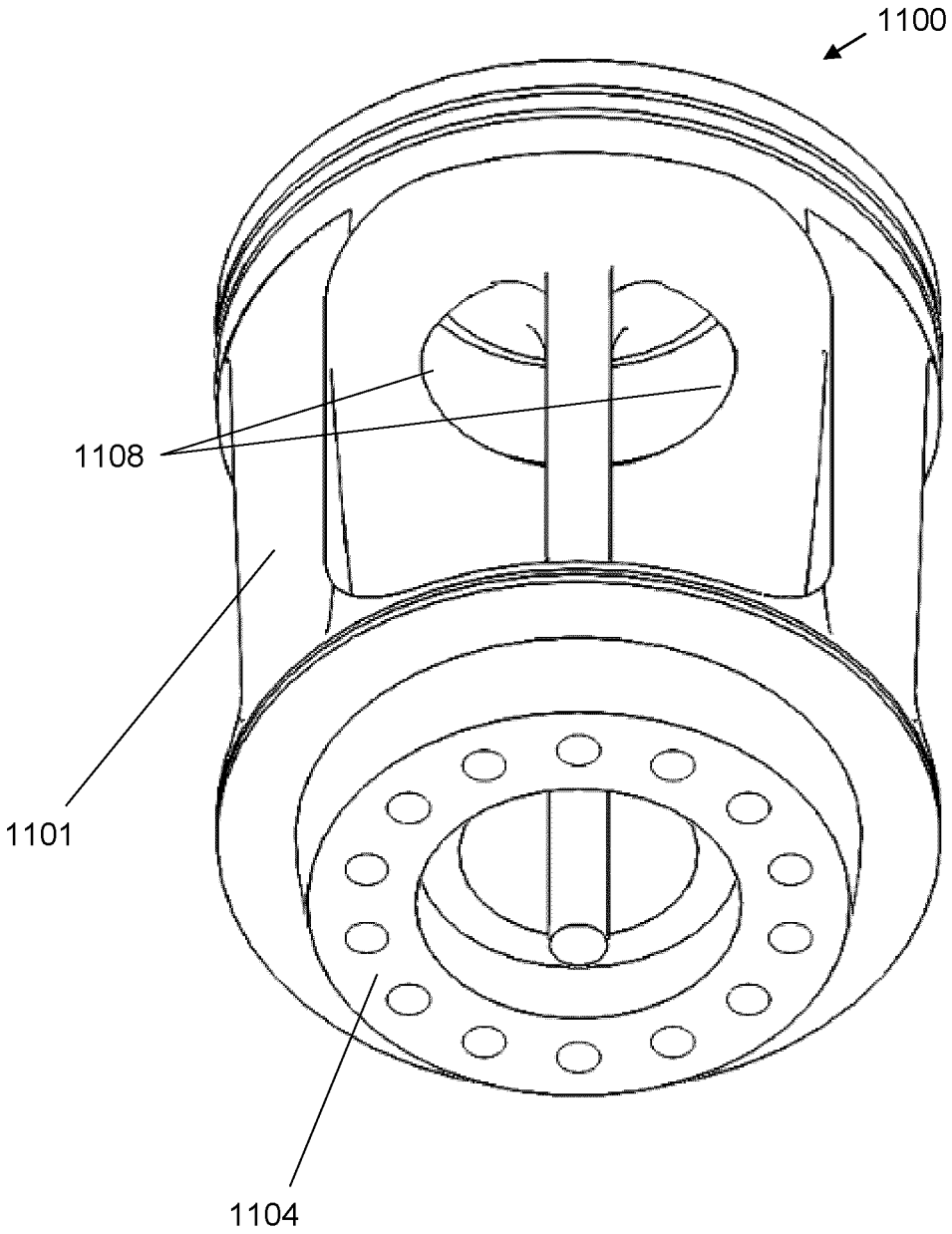
FIG. 9E shows another isometric view of the piston of FIG. 9B with a valve open from the second side.
Figure 9F:
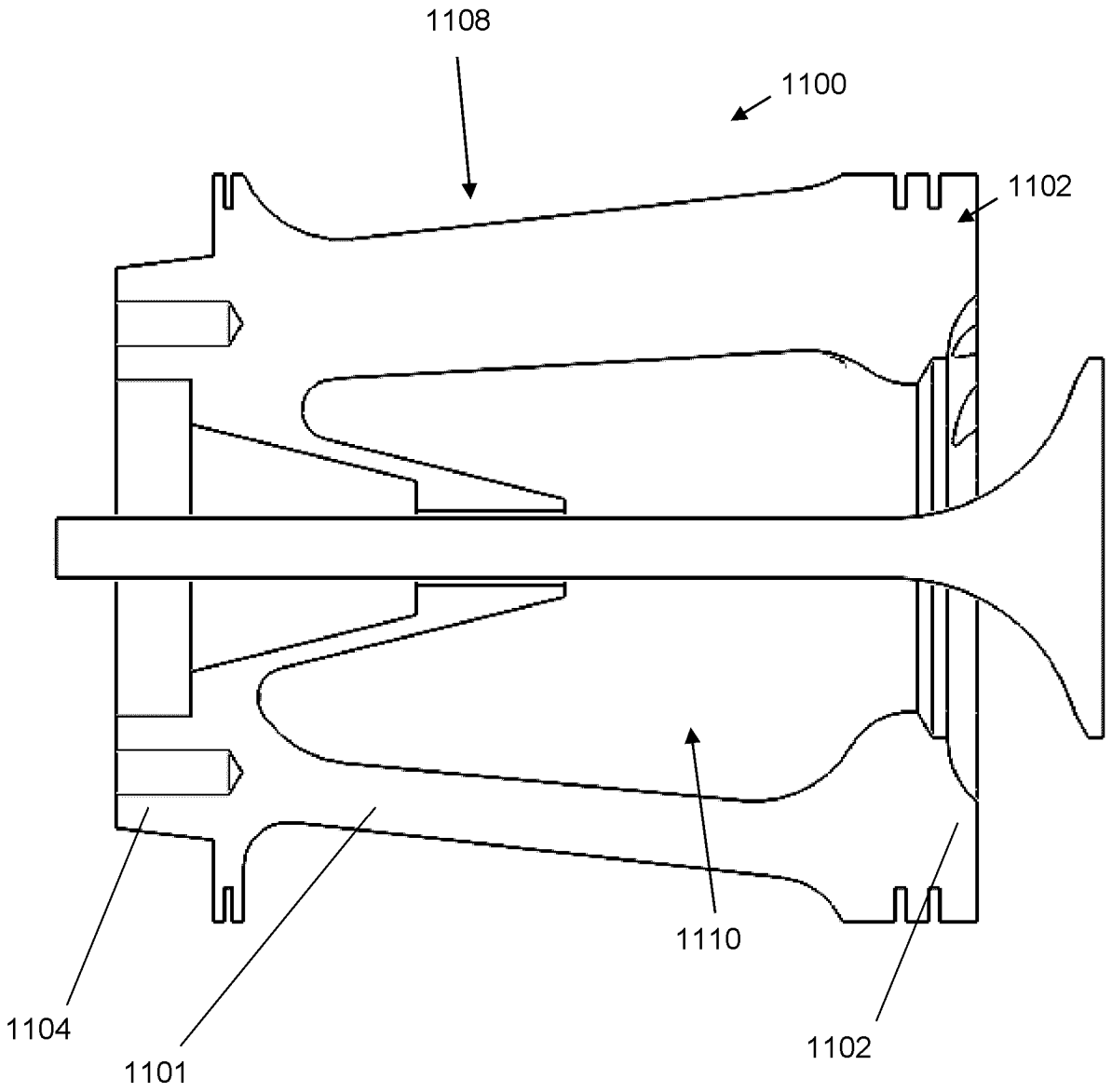
FIG. 9F shows a cross sectional view of the piston of FIG. 9B with a valve open.

It should be noted that the valve 200 may be concentric with the piston 1100, for example the valve head 208 may be a concentric circle with the opening 1109 defined by the piston head 1102 (see FIG. 9D). In at least one embodiment, the piston head 1102 may include a valve seat 1115 in the piston head 1102 (see FIG. 9D). Valve seat 1115 may be a recessed portion of the piston head 1102 sized and shaped to receive the valve head 208 when the valve head 208 is in a closed position. In at least one embodiment, the valve 200 and the opening 1109 may be centric within the piston head 1102 and/or the piston skirt 1104. In at least one embodiment, the valve 200 and the opening 1109 may not be centric within the piston head 1102 and/or the piston skirt 1104.

Figure 10A:
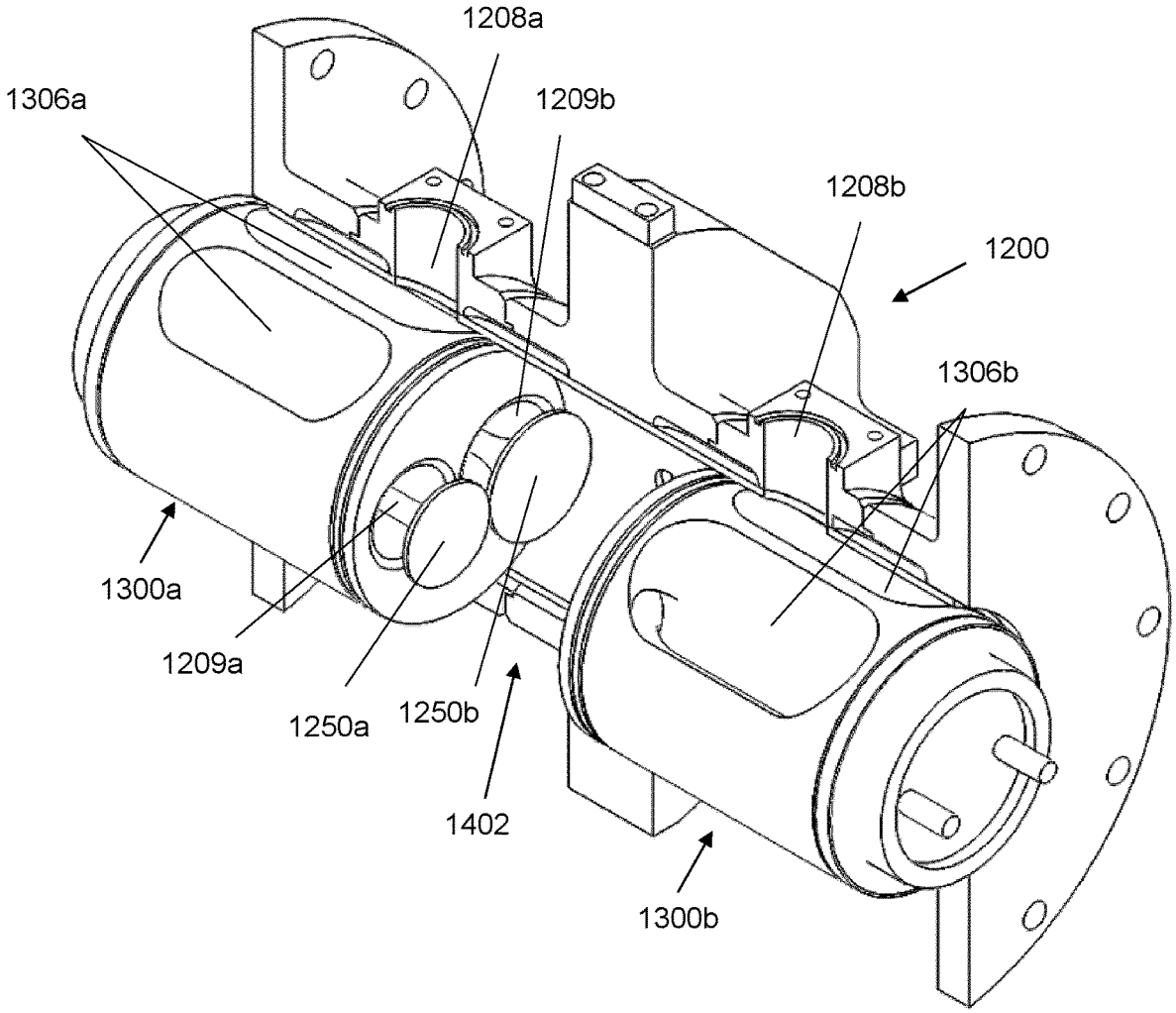
FIG. 10A shows an isometric view of a double piston linear generator, according to another embodiment described herein.
Figure 10B:
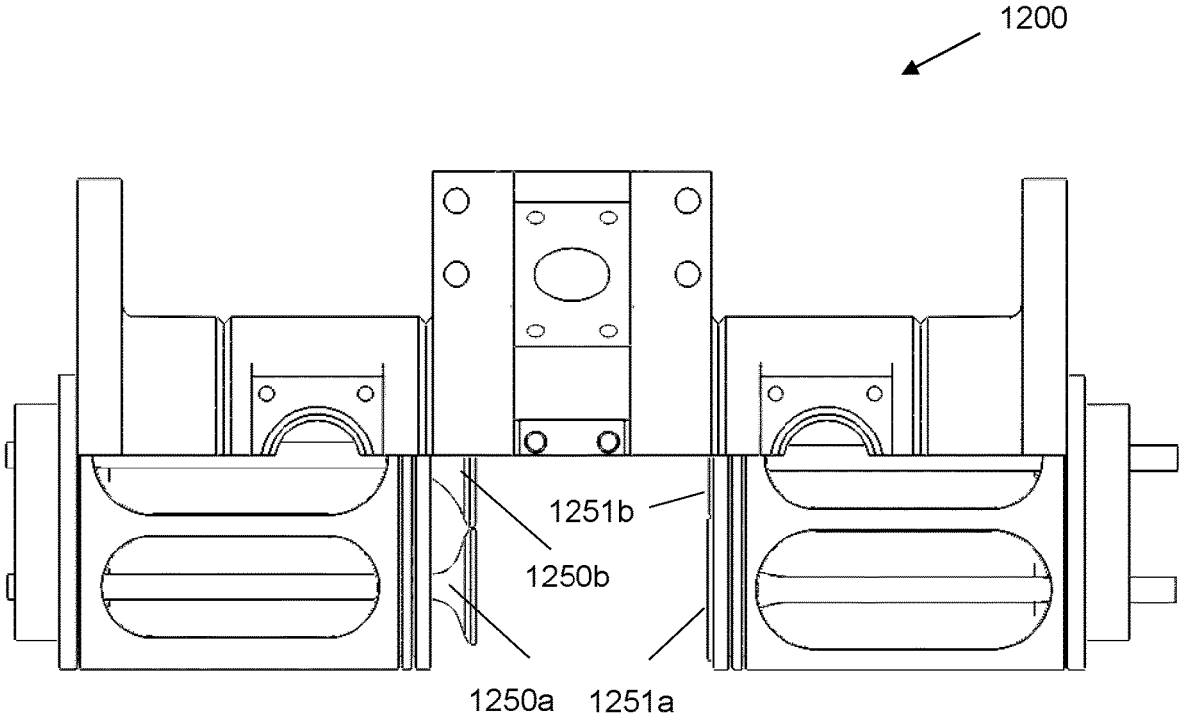
FIG. 10B is a cross sectional view of the linear generator of FIG. 10A.

FIG. 10A shows another embodiment of a linear generator 1200. In this embodiment, each piston 1300 includes two valves 1250*a*, 1250*b*. In the embodiment shown in FIG. 10A, the valves 1250*a*, 1250*b* of piston 1300*a* are configured as intake valves where the piston 1300*a* receives air through ports 1208*a* from the external piston volume and, when the valves the 1250*a*, 1250*b* of piston 1300*a* are open, the openings 1209*a*, 1209*b* provide a pathway for the air to travel into combustion chamber 1402. Following this, the valves 1251*a* and 1251*b* of piston 1300*b* are configured as exhaust valves where piston 1300*b* receives combustion gases form the combustion chamber 1402 and, when the valves the 1251*a*, 1251*b* of piston 1300*b* are open (see FIG. 10B), the openings therein (not shown) provide a pathway for the combustion gases to travel into an internal volume of piston 1300*b* and out through the ports of the side wall thereof. Accordingly, in this embodiment, valves 1250*a* and 1250*b* are actuated together and valves 1251*a* and 1251*b* are actuated together. Here, two ports 1306 as shown may lead to a single internal piston volume, or the internal piston volume may be partitioned.

It may be advantageous to have two intake valves in one piston (or two exhaust valves in one piston) as this configuration may provide a greater degree of efficient control over airflow. For example, in a low load case where low airflow volumes are needed, one valve may remain inactive, and one valve may operate to support the airflow. Operating a smaller and lighter valve takes less energy and thus reduces parasitic loss in the engine. When maximum airflow is required, the second valve can become active again to support more airflow.

Figure 11A:
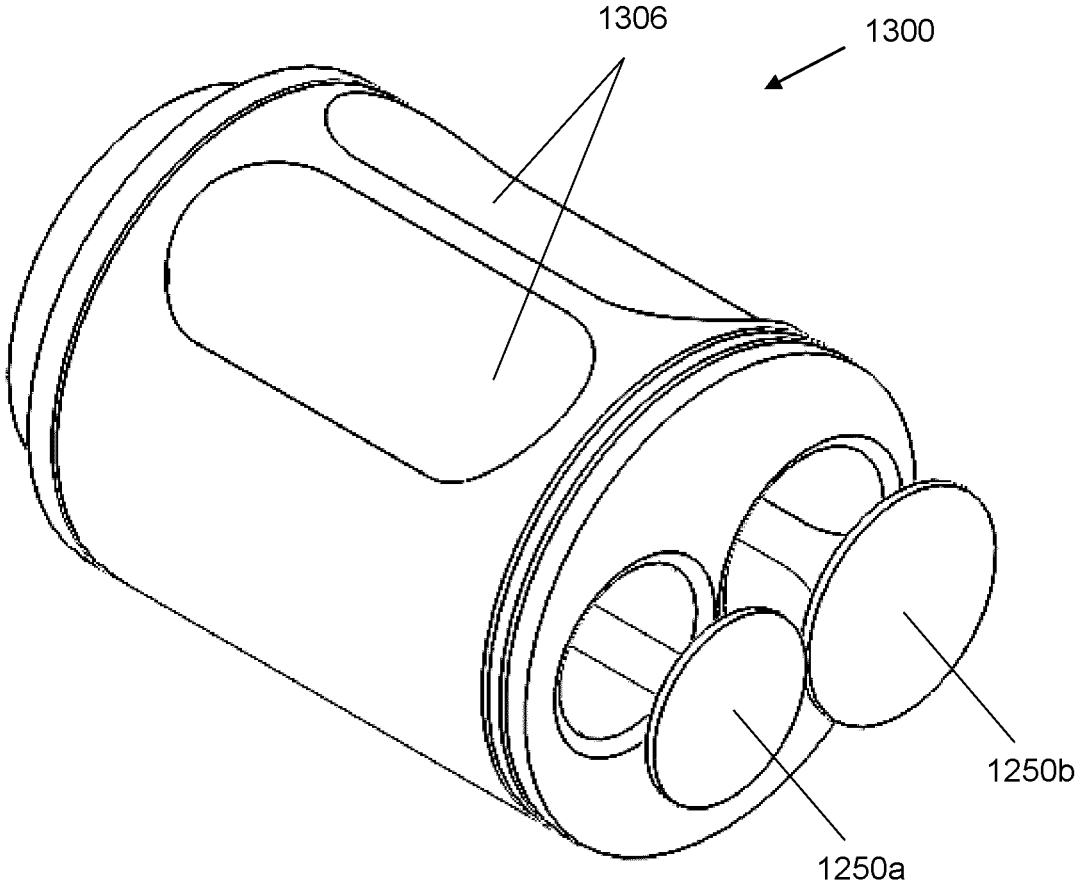
FIG. 11A is an isometric view of a piston of the linear generator of FIG. 10A, according to at least one embodiment described herein.
Figure 11B:
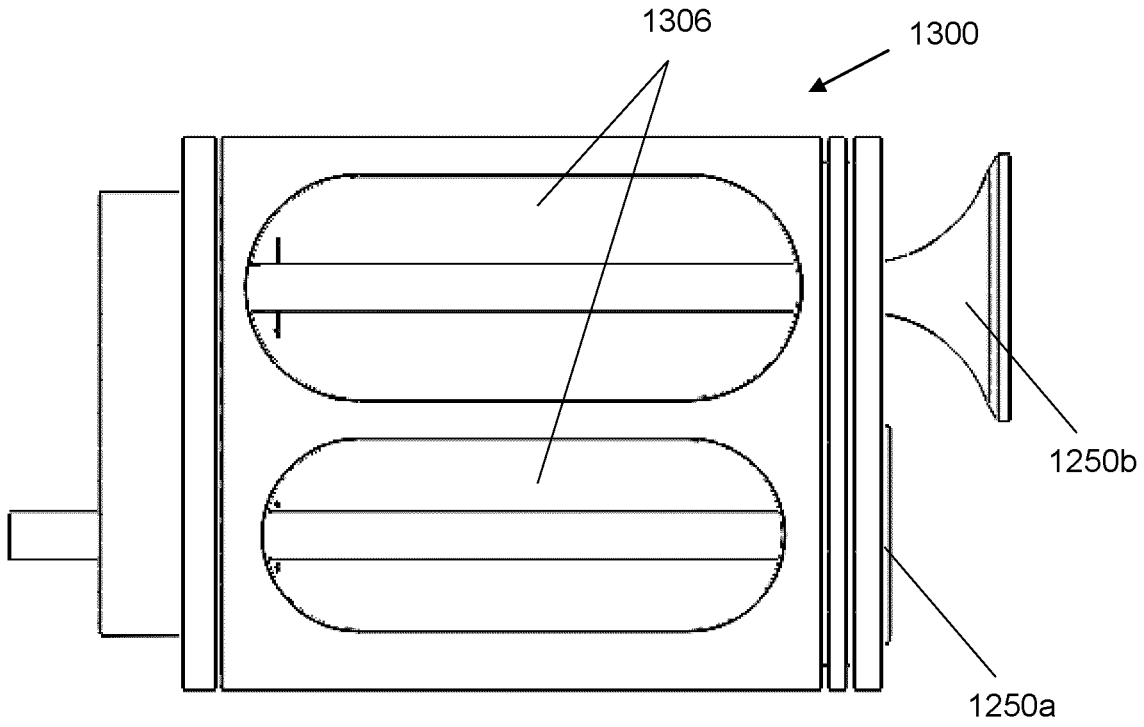
FIG. 11B is a cross sectional view of the piston of FIG. 11A.
Figure 12A:
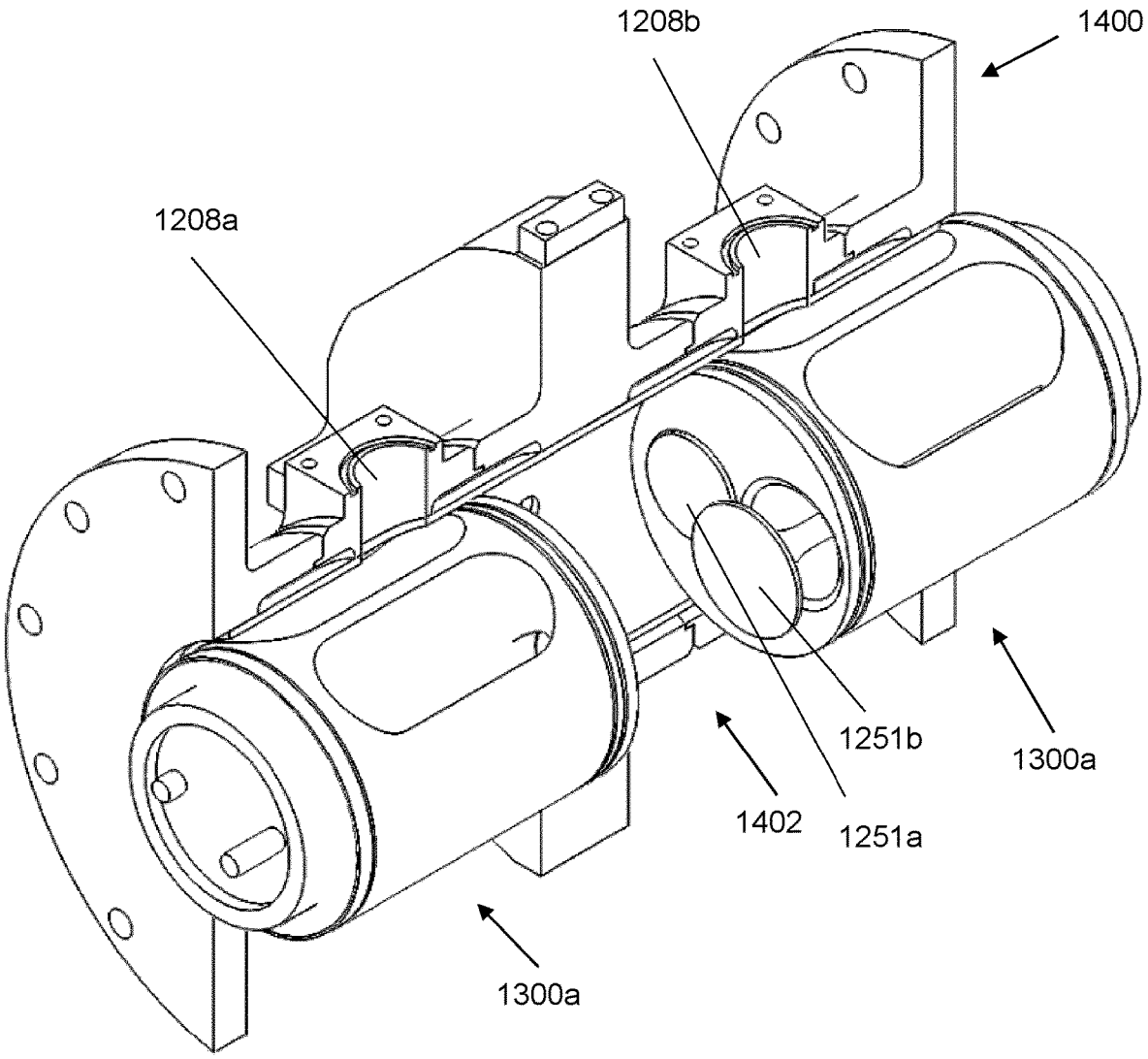
FIG. 12A is an isometric view of another double piston linear generator from a first side, according to another embodiment described herein.
Figure 12B:
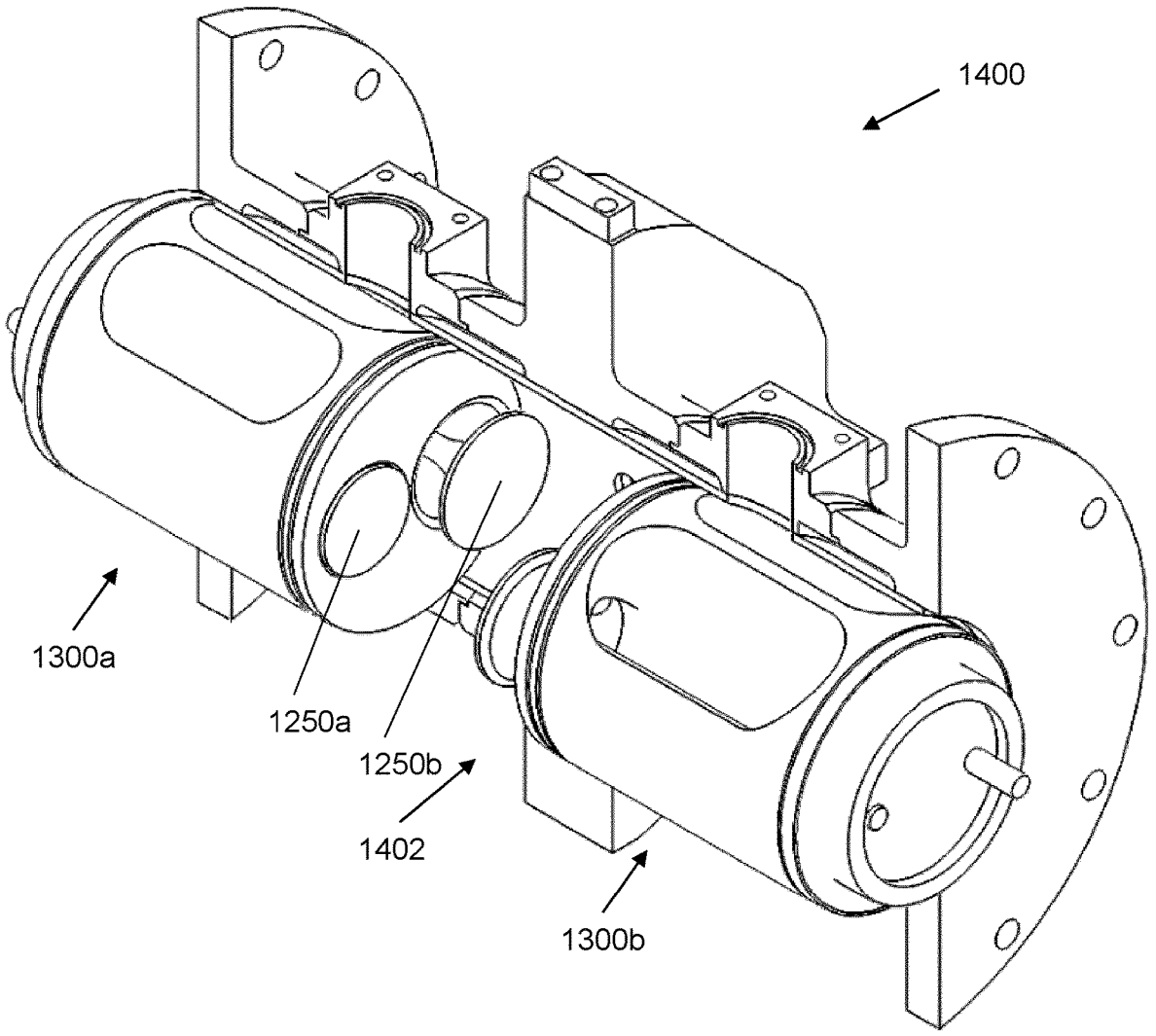
FIG. 12B is an isometric view of the double piston linear generator of FIG. 12A from a second side.
Figure 12C:
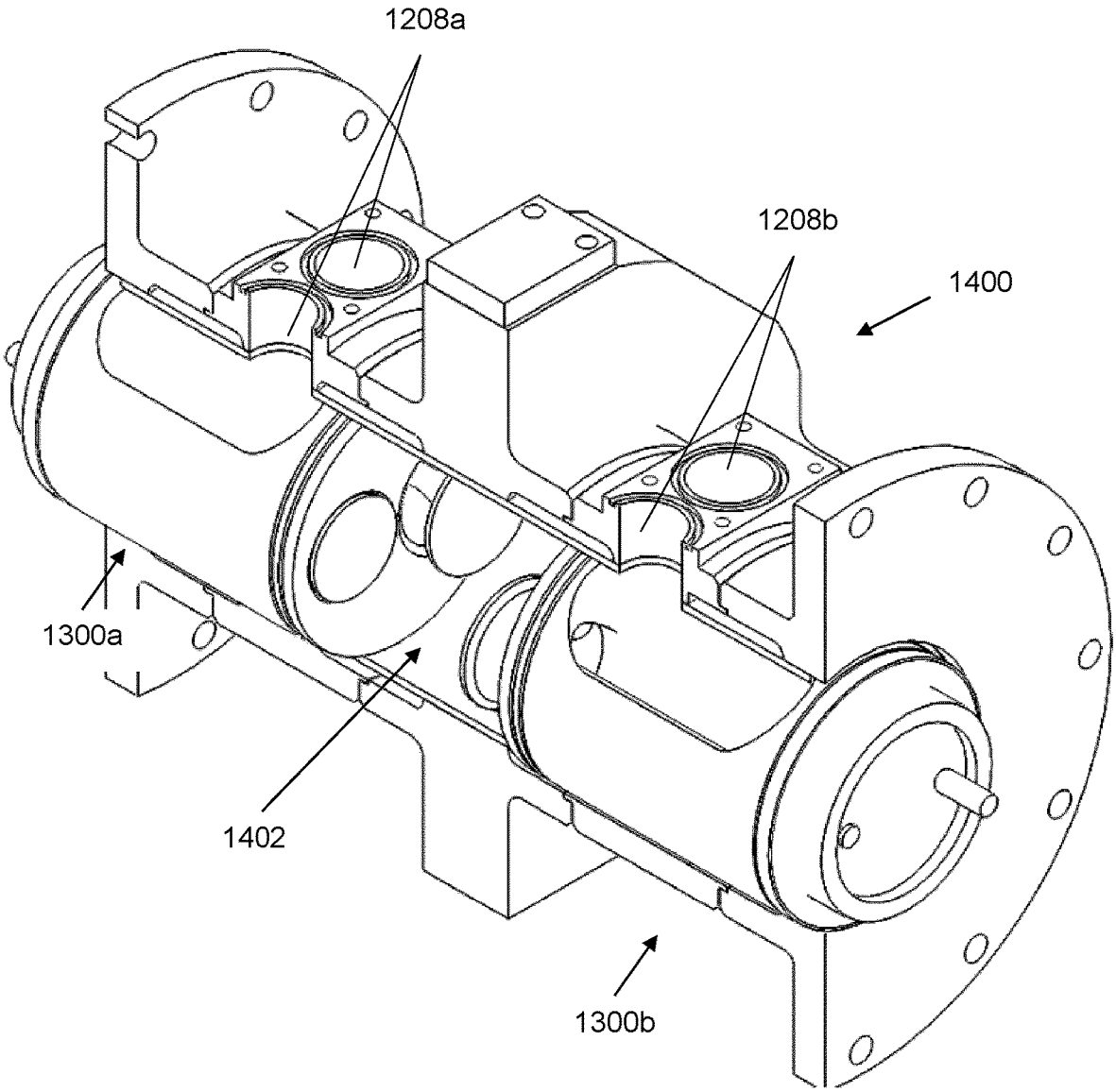
FIG. 12C is another isometric view of the double piston linear generator of FIG. 12A from the second side.
Figure 12D:
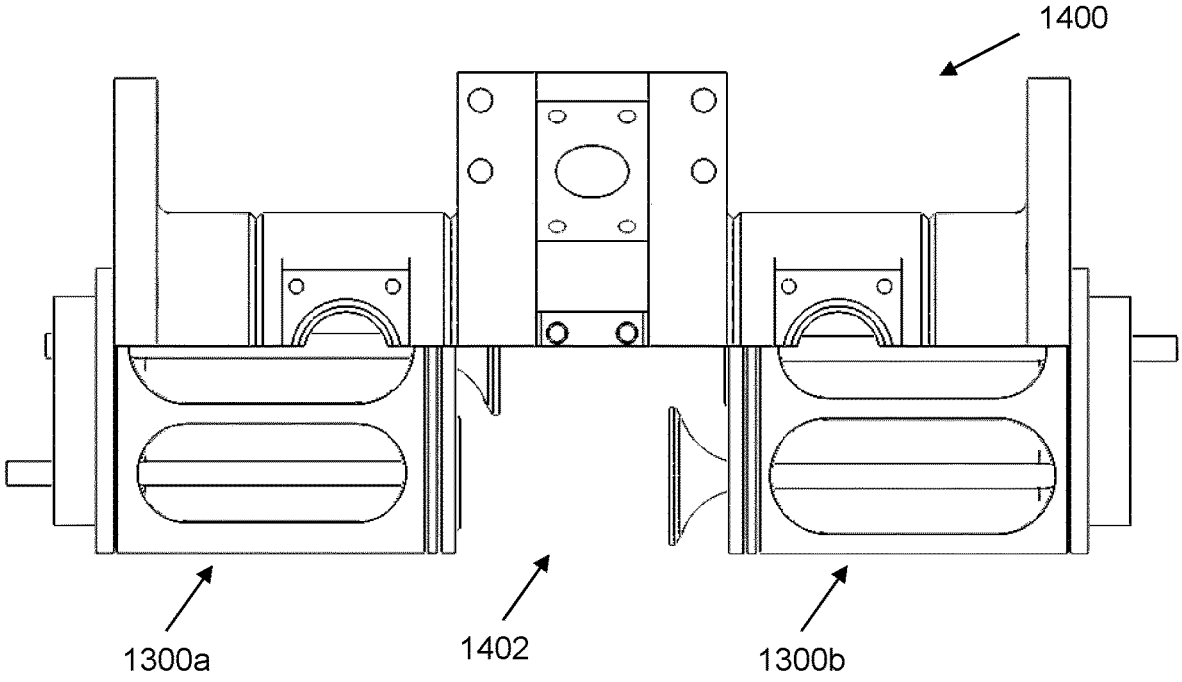
FIG. 12D is a cross sectional view of the linear generator of FIG. 12A.

FIG. 11A shows an isometric view of one of the pistons of linear generator 1200 of FIG. 10A. Herein, the reference number 1300 will refer to the piston generally and the reference numbers 1300*a* and 1300*b* will refer to specific pistons of linear generator 1200.

As shown in FIG. 11A, piston 1300 includes two valves 1250*a*, 1250*b*, which are both shown as being open. Valves 1250*a* and 1250*b* may be independently actuated or may be actuated together. Piston 1300 includes features that enable gas flow through the piston 1300, and an intake valve mechanism to block or allow gas flow through the piston head 1302 when desired. Piston 1300 includes one or more intake ports 1306 (e.g. two intake ports 1306). There may be more than one intake ports 1208, positioned radially around the cylinder of linear generator 1200, which allow gas flow into the exterior piston intake volume. There may be one or multiple piston intake ports 1306 that allow gas flow out of the exterior piston intake volume and into the interior piston intake volume. The interior piston intake volume is a volume inside the piston 1300 enclosed by the intake valves 1250*a*, 1250*b*. When the intake valves 1250*a*,1250*b* are closed, gas cannot flow from the interior piston intake volume into the combustion chamber 1402. Similarly, gases in the combustion chamber 1402 cannot flow into the interior piston intake volume when the intake valves 1250*a*,1250*b* are closed.

Turning to FIGS. 12A-D, illustrated therein is another embodiment of a linear generator 1400. In this embodiment, each piston 1300 again includes two valves 1250*a*, 1250*b*, however, here the valves 1250*a*, 1250*b* of piston 1300*a* are configured as an intake valve and an exhaust valve, respectively, and the valves 1251*a*, 1251*b* of piston 1300*b* are configured as an intake valve and an exhaust valve, respectively. To provide for this, the interior volume of piston 1300 is partitioned and the piston openings provide two separate pathways for the air to travel into combustion chamber 1402.

This arrangement may provide for balance of temperatures and forces in the piston. Each piston contains cool air inflows and hot exhaust gas outflows. Thermal management of pistons in a linear engine is difficult, so intake air coming through each piston can help mitigate overheating of the pistons. In a 4-stroke cycle, intake and exhaust valves open at different timings. If there is one of each valve in each piston, then when the intake valves open or the exhaust valves open, the reaction forces in each mover can occur at the same time, in opposing direction, so the opposed movers can remain in synchronized motion.

While the applicant's teachings described herein are in conjunction with various embodiments for illustrative purposes, it is not intended that the applicant's teachings be limited to such embodiments as the embodiments described herein are intended to be examples. On the contrary, the applicant's teachings described and illustrated herein encompass various alternatives, modifications, and equivalents, without departing from the embodiments described herein, the general scope of which is defined in the appended claims.

We claim:

1. A piston comprising:
- a piston head having an opening therein;
- a piston skirt opposed to the piston head;
- a piston shaft extending from the piston skirt;
- a piston side wall extending between the piston head and the piston skirt, the piston head, the piston skirt and the piston side wall co-operating to define an interior piston volume, the piston side wall having at least one port therein to provide a pathway between the interior piston volume and an exterior piston volume; and
- a valve mechanism movable relative to each of the piston head, the piston skirt and the piston side wall, the valve mechanism including:
  - a valve stem extending through the piston skirt and the interior piston volume; and
  - a valve head coupled to the valve stem and configured to cover the opening of the piston head;
- wherein the valve mechanism is movable between a first position where the valve head is covering the opening of the piston head and a second position where the valve head extends outwardly from the piston head into a combustion chamber of a motor to expose the opening and provide a pathway between the interior piston volume and the combustion chamber.

2. The piston of claim 1, wherein the piston shaft defines a valve guide hole configured to carry the valve stem.

3. The piston of claim 2, wherein the valve guide hole includes a gas bearing, a ball bearing, a frictional bearing material or lubrication to provide for smooth motion of the valve mechanism.

4. The piston of claim 2, wherein the valve guide hole is concentric with the valve head.

5. The piston of claim 2, further comprising a biasing mechanism positioned between the piston shaft and a valve spring retainer, the valve spring retainer engaging the valve stem to bias the valve head against the piston head.

6. The piston of claim 5, wherein the biasing mechanism is a spring.

7. The piston of claim 2, wherein the valve guide hole extends into a mover shaft of the motor, the mover shaft being joined to the piston shaft.

8. The piston of claim 7, wherein the valve stem extends through the valve guide hole into a valve cylinder of the mover shaft.

9. The piston of claim 1, wherein the port of the piston side wall is transverse to the opening in the piston head.

10. The piston of claim 1, wherein the piston side wall includes more than one port.

11. The piston of claim 10, wherein each port of the piston side wall is transverse to the opening in the piston head.

12. The piston of claim 1, wherein the piston side wall has a smaller radius than the piston head and the piston skirt.

13. The piston of claim 1, wherein the valve head and the opening of the piston head are concentric circles.

14. The piston of claim 1 further comprising a second valve mechanism movable relative to each of the piston head, the piston skirt and the piston side wall, the second valve mechanism including:
- a second valve stem extending through the piston skirt and the interior piston volume; and
- a second valve head coupled to the valve stem and configured to cover a second opening of the piston head;
- wherein the second valve mechanism is movable between a first position where the second valve head is covering the second opening of the piston head and a second position where the second valve head extends outwardly from the piston head into a combustion chamber of a motor to expose the opening and provide a pathway between the interior piston volume and the combustion chamber.

15. The piston of claim 14, wherein the interior piston volume includes a first interior piston volume and a second interior piston volume, the first interior piston volume being fluidly coupled to the combustion chamber by the first opening and the second interior combustion volume being fluidly coupled to the combustion chamber by the second opening.

16. A linear generator comprising:
- a combustion module; and
- at least one linear motor, each linear motor having at least one piston, the piston comprising:
  - a piston head having an opening therein;
  - a piston skirt opposed to the piston head;
  - a piston side wall extending between the piston head and the piston skirt, the piston head, the piston skirt and the piston side wall co-operating to define an interior piston volume, the piston side wall having at least one port therein to provide a pathway between the interior piston volume and an exterior piston volume; and
  - a valve mechanism movable relative to each of the piston head, the piston skirt and the piston side wall, the valve mechanism including:
    - a valve stem extending through the piston skirt and the interior piston volume into a mover shaft of the motor; and
    - a valve head coupled to the valve stem and configured to cover the opening of the piston head;
  - wherein the valve mechanism is movable between a first position where the valve head is covering the opening of the piston head and a second position where the valve head extends outwardly from the piston head into a combustion chamber of the combustion module to expose the opening and provide a pathway between the interior piston volume and the combustion chamber.

17. The linear generator of claim 16 comprising two linear motors, the linear motors being positioned on opposed sides of the combustion chamber.

18. The linear generator of claim 17, wherein, the combustion chamber is defined by a cylinder wall, the valve head of the piston of each linear motor and the piston head of the piston of each linear motor.

19. The linear generator of claim 18, wherein the combustion chamber is a sealed space.

20. The linear generator of claim 17, wherein, when the piston of each linear motor is in the second position, combustion gases in the combustion chamber may pass into the interior volume of each of the pistons.

* * * * *